US007077501B2

(12) United States Patent
Kitahara et al.

(10) Patent No.: US 7,077,501 B2
(45) Date of Patent: Jul. 18, 2006

(54) METHOD OF ASSEMBLING INK JET HEAD UNIT

(75) Inventors: Toshihiro Kitahara, Tachikawa (JP); Tatsutoshi Hashimoto, Machida (JP); Hiroshi Hashi, Tokyo (JP); Noriko Yokoyama, Hachioji (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 10/948,366

(22) Filed: Sep. 23, 2004

(65) Prior Publication Data

US 2005/0062799 A1 Mar. 24, 2005

Related U.S. Application Data

(63) Continuation of application No. PCT/JP03/03657, filed on Mar. 25, 2003.

(30) Foreign Application Priority Data

Mar. 25, 2002 (JP) ..... 2002-084121

(51) Int. Cl.

| | |
|---|---|
| ***B41J 2/15*** | (2006.01) |
| ***B41J 2/145*** | (2006.01) |
| ***B41J 2/14*** | (2006.01) |
| ***B41J 2/16*** | (2006.01) |

(52) U.S. Cl. ..... 347/40; 347/49

(58) Field of Classification Search ..... 347/40, 347/68–72

See application file for complete search history.

(56) References Cited

U.S. PATENT DOCUMENTS 6,315,390 B1 * 11/2001 Fujii et al. ..... 347/42

FOREIGN PATENT DOCUMENTS

| | | |
|---|---|---|
| JP | 63-37957 A | 2/1988 |
| JP | 63-297048 A | 12/1988 |
| JP | 1-253453 A | 10/1989 |
| JP | 2-167749 A | 6/1990 |

* cited by examiner

*Primary Examiner*—Thinh Nguyen
(74) *Attorney, Agent, or Firm*—Frishauf, Holtz, Goodman & Chick, P.C.

(57) ABSTRACT

A method of assembling an ink jet head unit, according to the present invention, is used to assemble the ink jet head unit configured by fixing a plurality of ink jet heads such that one ink jet head is fixed to the other ink jet head adjacent thereto, each ink jet head having an ink ejecting portion in which a plurality of nozzles to eject ink are arrayed. In this method, the ink jet heads are positioned by abutting the ink jet heads on a common positioning unit, and the plurality of ink jet heads are fixed such that one ink jet head is fixed to the other ink jet head adjacent thereto, in a state that the ink jet heads are so positioned as described above.

14 Claims, 17 Drawing Sheets

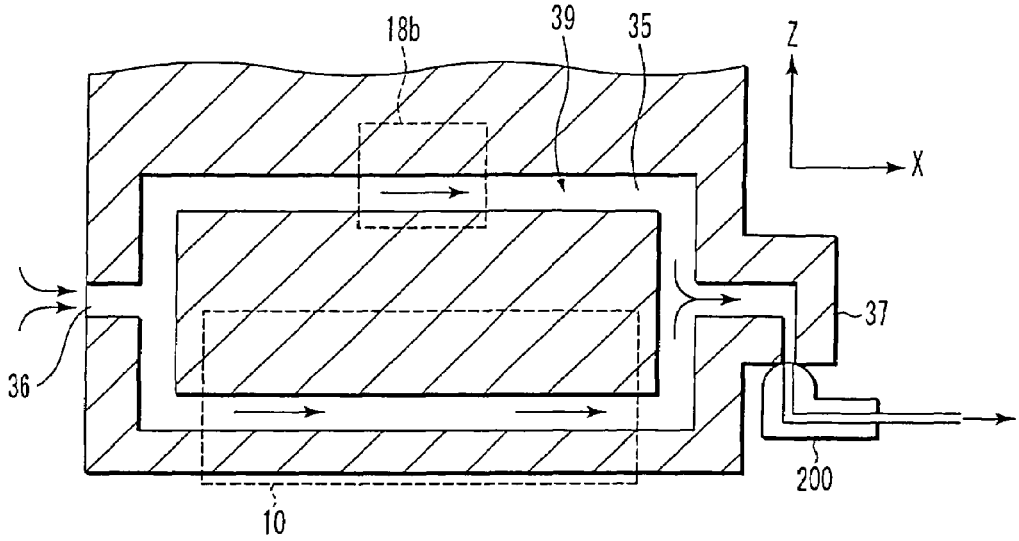
F I G. 6
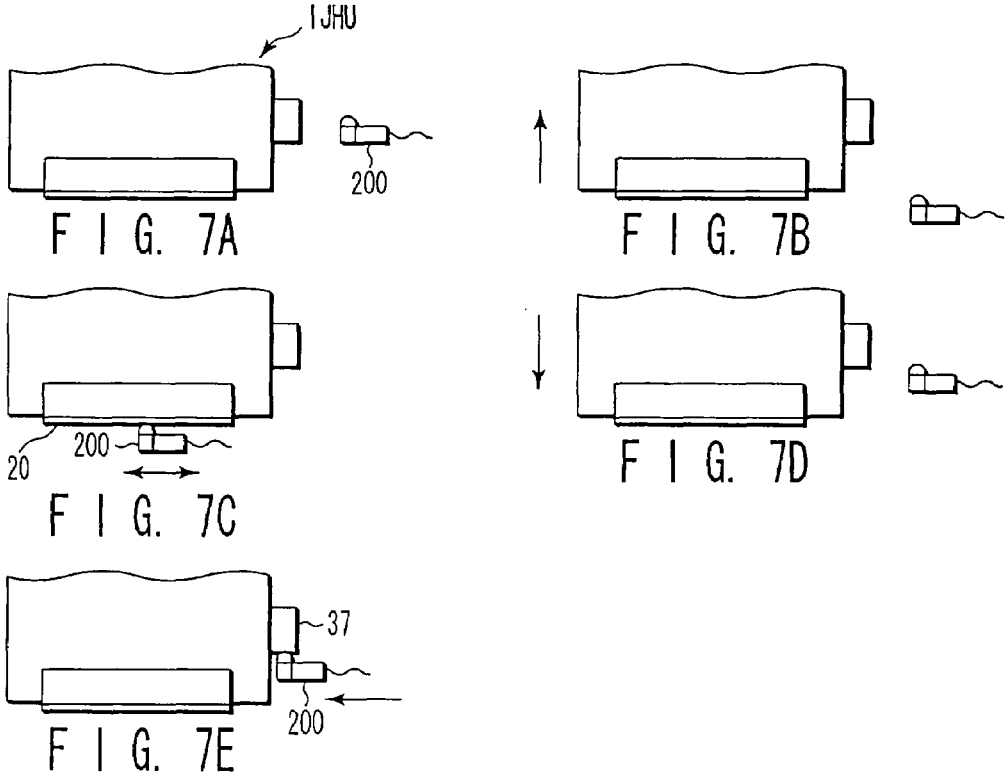
F I G. 7A
F I G. 7B
F I G. 7C
F I G. 7D
F I G. 7E

METHOD OF ASSEMBLING INK JET HEAD UNIT

CROSS-REFERENCE TO RELATED APPLICATIONS

This is a Continuation Application of PCT Application No. PCT/JP03/03657, filed Mar. 25, 2003, which was published in Japanese.

This application is based upon and claims the benefit of priority from prior Japanese Patent Application No. 2002-084121, filed Mar. 25, 2002, the entire contents of which are incorporated herein by reference.

BACKGROUND OF THE INVENTION

1. Field of the Invention

The present invention relates to a method of assembling an ink jet head unit of a laminated structure in which two ink jet heads each having the same structure as to each other are stuck together, and more particularly to a method of assembling an ink jet head unit which can accurately stick two ink jet heads together.

2. Description of the Related Art

An image recording apparatus for recording images has widely been known. There are various types of image recording apparatuses. For example, an image recording apparatus that uses an ink jet recording system such as an ink jet printer is recently widely used because it is inexpensive. This image recording apparatus records images on a recording medium by ejecting ink thereto. The image recording apparatus includes an ink jet head which is a type of droplet ejection devices for ejecting ink as described above. Hereinafter, a structure of a conventional ink jet head will be described with reference to FIGS. 25 and 26. FIG. 25 is a schematic exploded perspective view of the conventional ink jet head. FIG. 26 is a schematic vertical sectional view of the ink jet head of FIG. 25.

The ink jet head has an ink ejecting portion for ejecting ink. The ink ejecting portion includes a thin flat-plate shaped piezoelectric member 10. The piezoelectric member 10 has one end and the other end. The piezoelectric member 10 has an upper surface 10*a* extending from the one end to the other end, and a front end face 10*b* and a rear end face 10*c* each of which intersects the upper surface. The front end face 10*b* is positioned at the one end of the piezoelectric member 10, while the rear end face 10*c* is positioned at the other end of the piezoelectric member. Thus, the front end face 10*b* and the rear end face 10*c* are facing in opposite directions.

In the upper surface 10*a* of the piezoelectric member 10, a plurality of grooves 12 are formed in parallel to each other. The grooves 12 are arranged in a predetermined direction with a predetermined pitch P therebetween. In FIG. 25, each groove 12 extends from the one end of the piezoelectric member 10 to the other end thereof. A boundary portion between adjacent grooves 12 is a side wall for each of the adjacent grooves 12. This side wall extends from one end of the groove to the other end thereof. Each of the plurality of grooves 12 has the same dimensions as to each other. One end of each of the plurality of grooves 12 has an ejection opening 12*a*. The ejection opening 12*a* is opened in the front side face 10*b*. The other end of each of the plurality of grooves 12 has a supply end 12*b* configured such that its depth becomes gradually shallower as it near to the rear side face 10*c*, but it does not reach the rear side face 10*c*. Additionally, each of the plurality of grooves 12 has an upper surface side opening opened in the upper surface 10*a* of the piezoelectric member 10. This upper surface opening extends from the one end of the groove 12 to the other end thereof in a direction along the groove 12.

An electrode is formed on an inner surface of each of the plurality of grooves 12, the inner surface being constituted by the side walls and a bottom surface of each of the plurality of grooves 12. No reference numeral indicates this electrode to clarify the drawing. On the upper surface 10*a*, a conductive pattern 14 is formed in a region between the supply end 12*b* and the rear end face 10*c* as a conductive means electrically connected to the electrode formed in the groove 12.

The above-described ink jet head has an ink supply means 16 for supplying ink to the piezoelectric member. The ink supply means 16 includes an end flange 16*a* which covers a region in which the plurality of grooves 12 are opened on the upper surface 10*a* of the piezoelectric member 10.

The end flange 16*a* covers the plurality of upper surface side openings of the grooves 12, and is fixed to the upper surface 10*a*. The end flange 16*a* has an ink outlet 16*c* communicated with the supply ends 12*b* in the upper surface 10*a* of the piezoelectric member 10.

The ink supply means 16 further includes a small ink container 16*e* connected to an ink tank (not shown) which is an ink supply source. This small ink container 16*e* has a connection plug 16*d*, and is connected to the ink tank through an ink tube (not shown) connected to the connection plug 16*d*. The small ink container 16*e* is fixed to a surface of the end flange 16*a*, the surface facing in a direction opposite to the upper surface 10*a*, to cover the ink outlet 16*c*. The small ink container 16*e* has an ink reservoir 16*f* into which ink supplied from the ink tube flow. An ink filter 16*g* is installed in the ink reservoir 16*f*.

On the upper surface 10*a* of the piezoelectric member 10, one end portion of a flexible substrate 18 is fixed to a region in which a plurality of conductive patterns 14 is formed. A plurality of conductive patterns 18*a* is formed on the flexible substrate 18 to be electrically connected to the plurality of conductive patterns 14. Additionally, on the flexible substrate 18, an integrated circuit (IC) 18*b* is fixed to selectively send a voltage as a driving signal from an external power source (nod shown) to the conductive patterns 14.

The above-described ink ejecting portion includes a nozzle plate 20 which covers the ejection openings 12*a* of the plurality of grooves 12 on the front end face 10*b* of the piezoelectric member 10. The nozzle plate 20 has a plurality of nozzles 20*a* arranged in positions corresponding to approximate centers of the ejection openings 12*a*. On the nozzle plate 20, an outer surface opposite to the front end face 10*b* of the piezoelectric member 10 is treated to repel ink.

Now, an operation of the conventional ink jet head constituted as described above will be described. At first, ink is supplied from the ink tank to the ink jet head. Specifically, ink in the ink tank is pressurized, and the pressurized ink is supplied to the ink jet head. More specifically, the ink is supplied from the ink tank through the ink tube and the connection plug 16*d* to the ink reservoir 16*f* of the small ink container 16*e*. The supplied ink flows through the ink filter 16*g* and the ink outlet 16*c* of the end flange 16*a* into all of the grooves 12 of the piezoelectric member 10. The ink filled in the plurality of grooves 12 may leak through the plurality of nozzles 20*a* of the nozzle plate 20 to the outside. But, the leaked ink is repelled by the outer surface of the nozzle plate 20 and does not stick thereto.

When the application of the pressure to the ink in the ink tank is released, the pressure of the ink in the plurality of grooves 12 becomes low as compared to the atmospheric pressure. As a result, the ink forms a meniscus in each of the plurality of nozzles 20*a* of the nozzle plate 20 by surface tension.

The driving voltage is applied to the piezoelectric member 10 while the ink maintains the state of meniscus near the nozzles 20*a*. More specifically, the driving voltage is applied from a control circuit (not shown) through the flexible substrate 18 to the piezoelectric member 10. Yet more specifically, the IC 18*b* on the flexible substrate 18, which receives a control signal from the control circuit, selectively applies a driving signal (the driving voltage) through the electrodes in the plurality of grooves 12 to the piezoelectric member 10. For example, the control circuit is a control circuit of a personal computer connected to the image recording apparatus which uses the ink jet head. The groove 12 corresponding to the electrode to which the driving voltage is applied deforms the side walls to narrow the cross sectional area of the groove 12.

The deformation of the groove 12 generates a shock wave that is applied to the ink in the groove 12. By this shock wave, a predetermined amount of ink drop is ejected from the nozzle 20*a* corresponding to the groove 12 to the outside. The ejected ink drop lands on the recording medium to form a part of an image.

Incidentally, each groove 12 is formed in the upper surface 10*a* of the piezoelectric member 10 by a rotary cutter blade. Further, the side wall between the adjacent grooves 12 must have sufficient durability because it is deformed as described above. Thus, the piezoelectric member 10 must have a certain thickness. In order to secure the durability, the number of grooves per one inch (25.4 mm) is limited to about 200 at present. The number of grooves formed per one inch is generally 180. In this case, a nozzle density (a density of ejected ink drops) of the ink jet head is 180 dpi.

In recent years, an image recording apparatus which can record an image of little dot granular touch with a higher resolution at a high speed have been demanded. To reduce the granular touch, a size of one ink drop is preferably miniaturized more. However, if the size of ink drop is miniaturized as described above, the nozzle density in the ink jet head must be increased to perform a high-speed recording in a predetermined printing area.

To increase the nozzle density, for example, two ink heads may be stuck together. That is, the higher nozzle density can be achieved by sticking the two ink jet heads to form a single ink jet head unit. To constitute the ink jet head unit, the two ink jet heads are prepared as shown in FIGS. 27 and 28. Then, these ink jet heads are stuck together so that the bottom surfaces of the piezoelectric members 10 of the ink jet heads can be in intimately contact with each other. In this time, the nozzles 20*a* of one ink jet head are shifted from those of the other ink jet head by a half of one nozzle pitch P, i.e., ½P, along the nozzle arraying direction. That is, one of the ink jet heads and the other are stuck together in such a shifted arrangement.

The ink jet head unit constituted in the aforementioned manner has a nozzle density which is two times of that of the single ink jet head. However, it is difficult to accurately stick the two ink jet heads to each other is difficult.

The present invention is derived from these circumstances, and an object of the present invention is to provide a method of assembling ink jet head unit by which a plurality of ink jet heads can be accurately stuck to each other.

BRIEF SUMMARY OF THE INVENTION

According to one aspect of the present invention, a method of assembling an ink jet head unit, configured by fixing a plurality of ink jet heads such that one ink jet head is fixed to the other ink jet head adjacent thereto, each ink jet head having an ink ejecting portion in which a plurality of nozzles to eject ink are arrayed, comprises: positioning the ink jet heads by abutting the ink jet heads on a common positioning unit, and fixing the plurality of ink jet heads such that one ink jet head is fixed to the other ink jet head adjacent thereto, in a state that the ink jet heads are so positioned as described above.

With this method, the plural ink jet heads are positioned by the common positioning unit. That is, a plurality of positioning units is not used to position the plural ink jet heads. The common positioning unit which is different from the individual positioning units needs not individual positioning operations for the plural ink jet heads. Therefore, the common positioning unit can position the plural ink jet heads more accurately than in a case that the individual positioning units position the plural ink jet heads.

Further, with this method, the plurality of ink jet heads is fixed such that one ink jet head is fixed to the other ink jet head adjacent thereto, in a state that the ink jet heads are so positioned as described above. Therefore, the ink jet head unit assembled by the above described method can maintain a high accuracy of a positional relationship between the ink jet heads. That is, the ink jet head unit can be assembled by the method with a high accuracy.

In the above described method, each of the ink jet heads may have a holding member to hold the ink ejecting portion. And, in the positioning of the ink jet heads, each ink jet head may be positioned by abutting a part of the holding member thereof on the common positioning unit.

As described above, the holding member of each ink jet head may be positioned by the common positioning unit. Therefore, the common positioning unit may position each ink jet portion through the holding member corresponding thereto. That is, the above described method of assembling an ink jet head unit may position the ink ejecting portions with a high accuracy.

In the positioning of the ink jet heads in the above described method, each ink jet head may be positioned by abutting the ink ejecting portion thereof on the common positioning unit.

As described above, the ink ejecting portion of each ink jet head may be directly positioned by the common positioning unit. Therefore, since each ink ejecting portion may be positioned without through any other member, each ink ejecting portion may be positioned with a high accuracy.

In the above described method, the common positioning unit may have a common eccentric cam member which operates to at least one of the ink jet head. And, the positioning of the ink jet heads may include adjusting a position of the at least one ink jet head with respect to the other ink jet head in the nozzle arraying direction by rotating the eccentric cam member.

As described above, a position of the at least one ink jet head with respect to the other ink jet head in the nozzle arraying direction may be finely adjusted by the eccentric cam member.

In the above described method, the common positioning unit may have a common positioning pin member which operates to the plurality of ink jet heads. And, the positioning of the ink jet heads may include adjusting positions of the ink jet heads in a direction orthogonal to the nozzle arraying direction by abutting the ink jet heads on the positioning pin.

As described above, since the ink jet heads may be positioned by the common positioning pin, the positioning of the ink jet heads may be performed with a high accuracy.

In the arraying-direction positioning of the at least one ink jet head in the above described method, a position of the at least one ink jet head to the ink jet head adjacent thereto may be adjusted to shift a position of each nozzle of the at least one ink ejecting portion from that of the adjacent ink ejecting portion by a predetermined distance.

As described above, an array of nozzles in the at least one ink ejecting portion is shifted from that in the other ink ejecting portion by a predetermined distance. With this shifting, the assembled ink jet head unit may have a larger number of ink nozzles in the nozzle arraying direction than the number of ink nozzles of one ink ejecting portion in the nozzle arraying direction. Therefore, with above described the method, the assembled ink jet head unit may have a higher nozzle density than that in one ink ejecting portion or may have a larger nozzle arraying region in the nozzle arraying direction than that in one ink ejecting portion.

In the above described method, the predetermined distance may be ½ of one pitch in the nozzle array.

As described above, a position of the at least one ink jet head to the ink jet head adjacent thereto may be adjusted to shift a position of each nozzle of the at least one ink ejecting portion from that of the adjacent ink ejecting portion by ½ of one pitch in the nozzle array. With this shifting, all of the nozzles in the ink jet head unit are equally arranged with each other in the nozzle arraying direction. Therefore, with this method, the assembled ink jet head unit may have equally arranged nozzles with a higher nozzle density than that in one ink ejecting portion.

In the fixing of the plurality of ink jet heads in the above described method, the holding members may be bonded by an adhesive to be fixed to each other.

As described above, since the holding members may be bonded by the adhesive, the holding members may be securely fixed to each other without shifting a positional relationship between them.

In the fixing of the plurality of ink jet heads in the above described method, the holding members may be fixed to each other by screws.

As described above, since the holding members may be fixed to each other by screws, the holding members may be securely fixed to each other without shifting a positional relationship between them.

In the above described method, the ink jet head unit may comprise a common holding member having both surfaces to which the ink ejecting portions are fixed. And, in the fixing of the plurality of ink jet heads, the ink ejecting portions may be bonded by an adhesive to the both surfaces of the common holding member.

As described above, in this method, since the plural ink ejecting portions are bonded by an adhesive, the plural ink ejecting portions may be assembled with a higher accuracy than in a case that each of the plural ink ejecting portions has a holding member.

In the fixing of the plurality of ink jet heads in the above described method, the ink ejecting portions may be bonded by an adhesive to be fixed to each other.

As described above, in this method, since the ink ejecting portions may be bonded by the adhesive to be fixed to each other, the ink ejecting portions may be securely fixed to each other without shifting a positional relationship between them.

In the fixing of the plurality of ink jet heads in the above described method, the common positioning unit used for positioning the ink jet heads may be fixed to the ink jet heads.

As described above, in this method, since the common positioning unit may be fixed to the ink jet heads, the common positioning unit may be used not only for positioning the ink jet head unit to the other member but also for attaching the ink jet head unit to the other member. Therefore, with this method, the ink jet head unit which can easily perform the positioning and attaching thereof to the other member may be assembled.

In the fixing of the plurality of ink jet heads in the above described method, an adhesive may be applied so that a fixing range between the holding members or between the common holding member and each ink ejecting portion or between the ink ejecting portions is narrower than a width of each ink ejecting portion in the nozzle arraying direction.

As described above, since fixing range between the holding members or between the common holding member and each ink ejecting portion or between the ink ejecting portions may be narrow as described above, the thermal expansion of each ink ejecting portion in the nozzle arraying direction may be allowed more easily than in a case that a fixing range between the holding members or between the common holding member and each ink ejecting portion or between the ink ejecting portions is over the whole of a width of each ink ejecting portion in the nozzle arraying direction. Therefore, the ink jet head unit assembled with this method can decrease an internal stress generated therein when the ink jet head unit is thermally expanded, so that the damage of the ink jet head unit by its thermal expansion is prevented.

BRIEF DESCRIPTION OF THE SEVERAL VIEWS OF THE DRAWING

FIG. 6 is a sectional view showing an air flow through a flow path formed in base plates of an ink jet head unit according to a seventh embodiment;

FIG. 7A is a view showing one of operations of a suction pen relative to the ink jet head unit of FIG. 6;

FIG. 7B is a view showing one of operations of a suction pen relative to the ink jet head unit of FIG. 6;

FIG. 7C is a view showing one of operations of a suction pen relative to the ink jet head unit of FIG. 6;

FIG. 7D is a view showing one of operations of a suction pen relative to the ink jet head unit of FIG. 6;

FIG. 7E is a view showing one of operations of a suction pen relative to the ink jet head unit of FIG. 6;

DETAILED DESCRIPTION OF THE INVENTION

[First Embodiment]

(Constitution)

At first, a first embodiment of an ink jet head unit IJHU will be described with reference to FIGS. 1 to 5.

Figure 1:
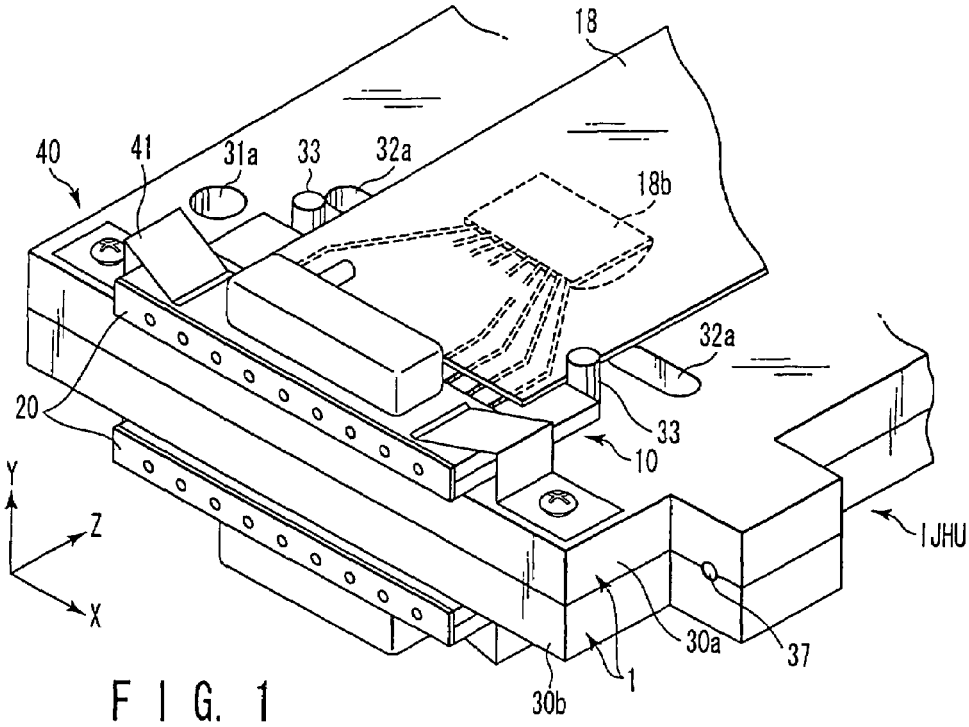
FIG. 1 is a perspective view of an ink jet head unit according to a first embodiment.
Figure 2:
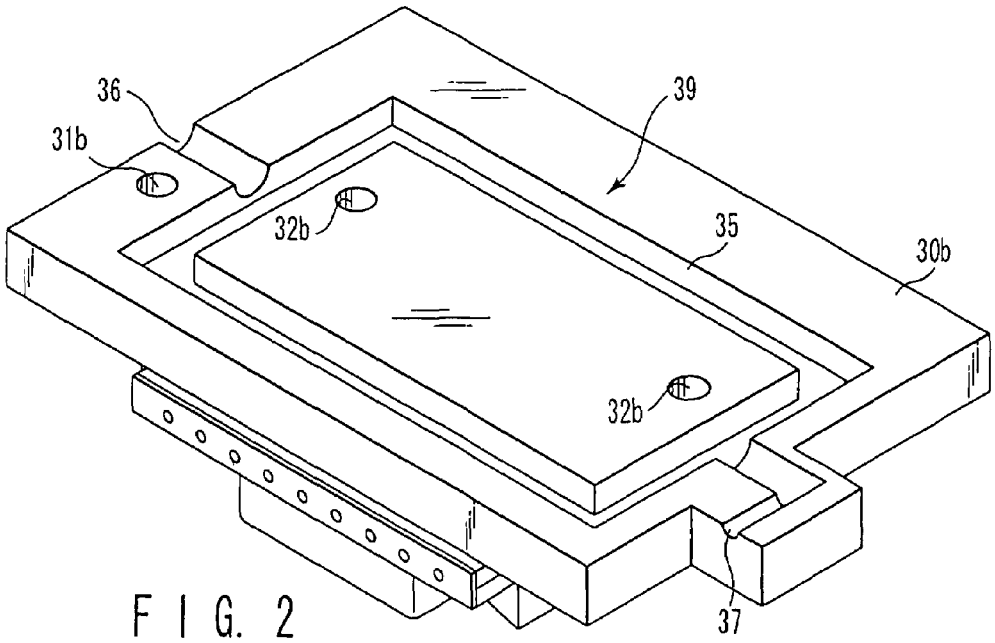
FIG. 2 is a perspective view showing a shape of a bottom surface of a second base plate of the ink jet head unit of FIG. 1.
Figure 3:
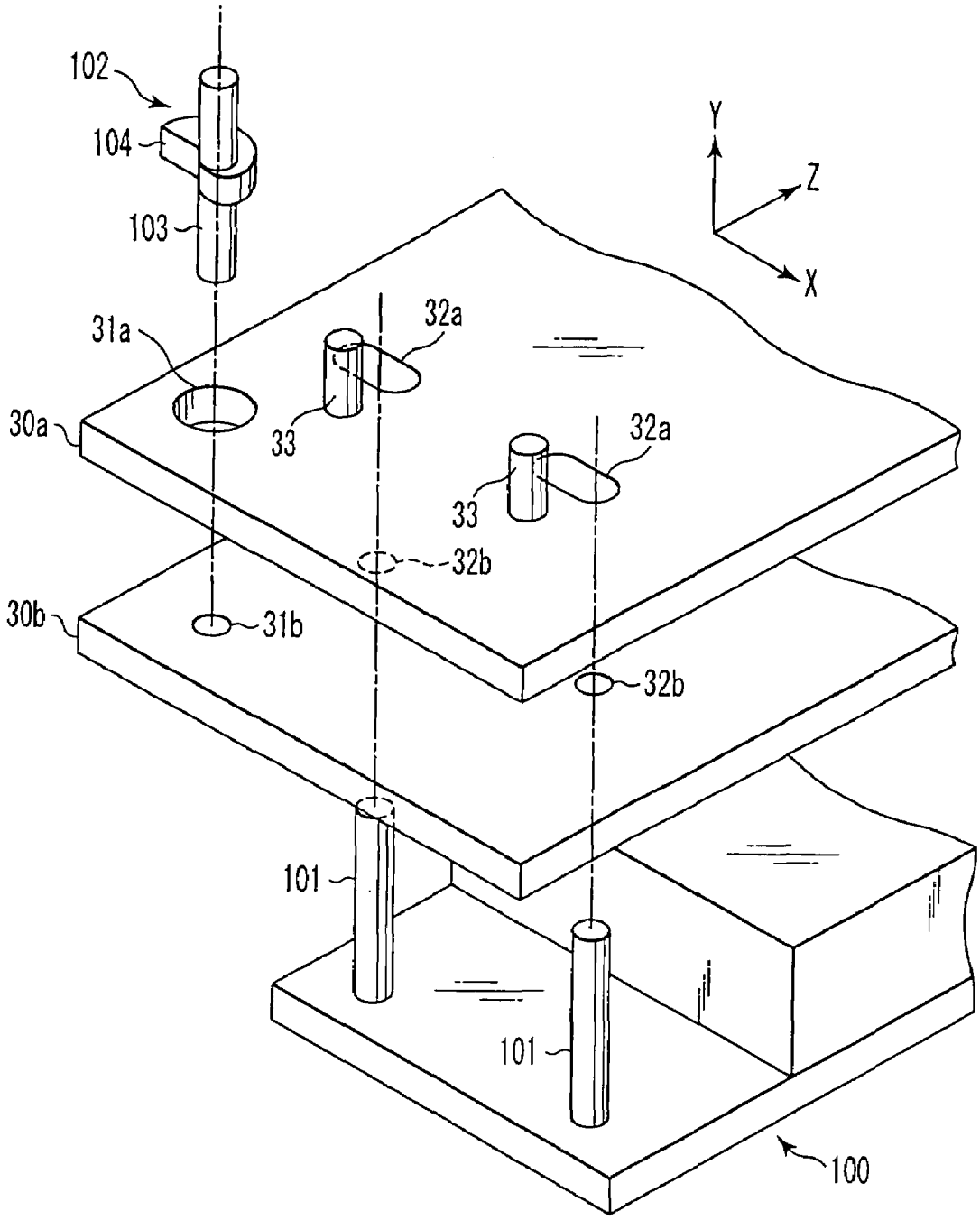
FIG. 3 is a perspective view showing a positional relation among two base pates, an adjustment base, and a cam member in the ink jet head unit of FIG. 1.
Figure 4:
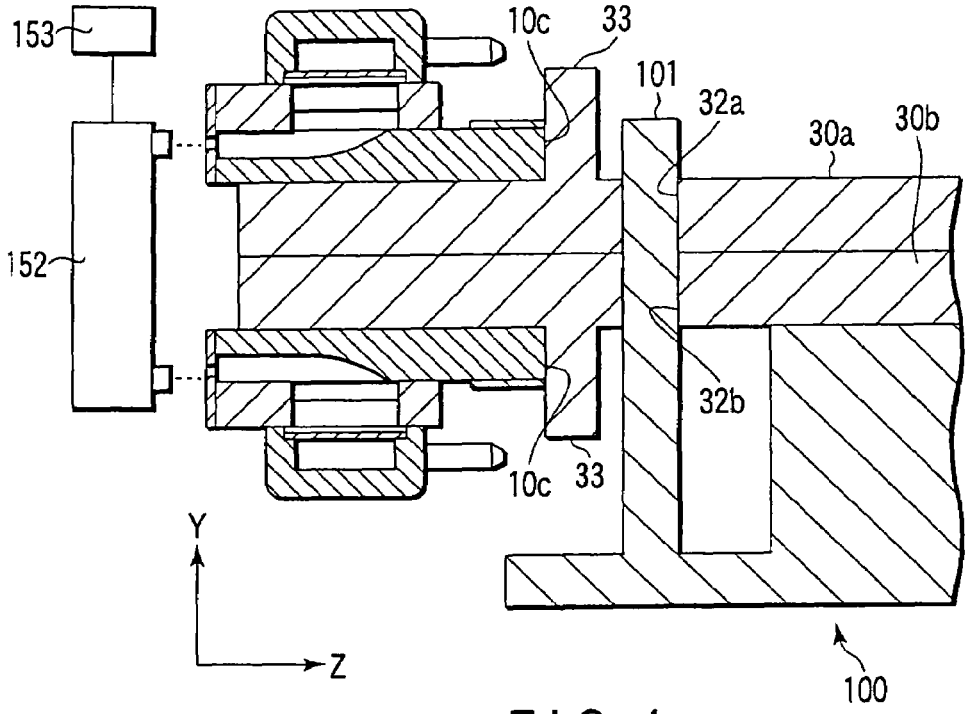
FIG. 4 is a sectional view showing ink jet heads of FIG. 1 while a positional adjustment between them in a Z direction is performed.
Figure 5:
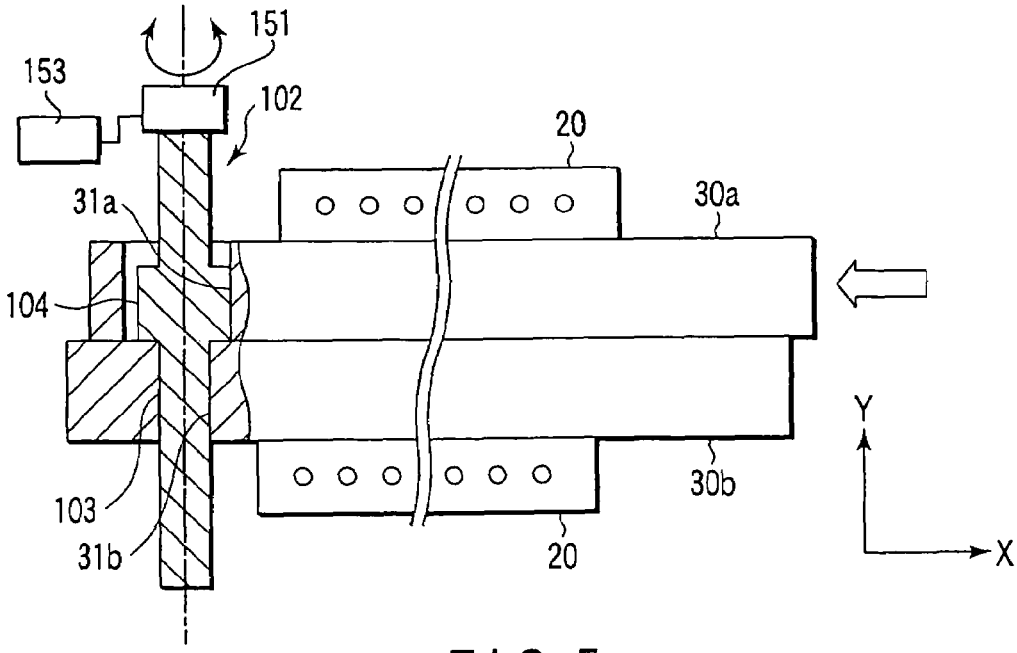
FIG. 5 is a partially sectioned front view of the ink jet heads of FIG. 1 while a positional adjustment between them in an X direction is performed.

FIG. 1 is a perspective view of the ink jet head unit IJHU of the embodiment. FIG. 2 is a perspective view showing a shape of a bottom surface of a second base plate of the ink jet head unit IJHU. FIG. 3 is a perspective view showing a positional relation among two base plates, an adjustment base, and a cam member in the ink jet head unit IJHU. FIG. 4 is a sectional view showing ink jet heads of FIG. 1 while a positional adjustment between them in a Z direction is performed. FIG. 5 is a partially sectioned front view of the ink jet head of FIG. 1 while a positional adjustment between them in an X direction is performed.

The ink jet head unit IJHU has two ink jet heads 1. Each ink jet head 1 includes an ink ejecting portion provided with a piezoelectric member 10 for ejecting ink, and a base plate to which the ink ejecting portion is fixed. The ink jet head unit IJHU is configured by sticking and fixing the base plates to each other.

A constitution of the ink jet head 1 is similar to that described above in the "BACKGROUND OF THE INVENTION", and thus detailed description thereof will be omitted.

The upper one of the two base plates in FIG. 1 is denoted by a reference numeral 30*a* and defined as a first base plate in FIG. 1. Similarly, the lower one of the two base plates in FIG. 1 is denoted by a reference numeral 30*b* and defined as a second base plate. The first and second base plates 30*a*, 30*b* are made of a material having high thermo conductivity, e.g., aluminum. Such a material can efficiently radiate heat generated in the piezoelectric member 10 and in the integrated circuit (IC) 18*b*. Fixing members 40 are fixed to the first side surfaces of the first and second base plates 30*a*, 30*b*. In this embodiment, the fixing members 40 are fixed by screws. However, they can be fixed by other well-known fixing means such as an adhesive. Additionally, the fixing members 40 can be configured integrally with the first and second base plates 30*a*, 30*b*.

The piezoelectric members 10 and the flexible substrates 18 on which the IC 18*b* of the ink jet heads 1 are disposed are fixed to the first side surfaces of the first and second base plates 30*a*, 30*b*. The piezoelectric members 10 are fixed on the first and second base plates 30*a*, 30*b* by the fixing members 40, and the flexible substrates 18 are directly bonded to the first and second base plates 30*a*, 30*b* by an adhesive.

In this specification, a direction along the arraying direction of the nozzles 20*a* is defined as an X direction. A direction orthogonal to the X direction is defined as a Z direction. Further, a direction orthogonal to the X and Z directions is defined as a Y direction. In this embodiment, an ink ejecting direction of the piezoelectric member 10 roughly coincides with the Z direction. Further, an extending direction of the groove 12 of the embodiment also roughly coincides with the Z direction. More further, a stacking direction in which the two ink jet heads 1 are stuck roughly coincides with the Y direction.

A round hole 31*a* and two oblong holes 32*a* for adjustment in the X direction are formed in the first base plate 30*a*. In the second base plate 30*b*, a round hole 31*b* is formed in a position corresponding to the round hole 31*a* of the first base plate 30*a*, and two round holes 32*b* are formed in positions corresponding to the two oblong holes 32*a* of the first base plate 30*a*.

A diameter of the round hole 31*b* of the second base plate 30*b* is smaller than that of the round hole 31*a* of the first base plate 30*a*. A cam member 102 (described later) is inserted into the round holes 31*a* and 31*b* (see FIG. 3).

Positioning pins 101 of a positioning unit (described later) are inserted into the two oblong holes 32*a* of the first base plate 30*a* and the two round holes 32*b* of the second base plate 30*b* (see FIG. 3). A diameter of the round hole 32*b* is so set that it is substantially equal to an outer diameter of the positioning pin 101. A size of the oblong hole 32*b* in a short direction (Z direction) is so set that it is substantially equal to the outer diameter of the positioning pin 101. A longitudinal direction of the oblong hole 32*b* coincides with the X direction. That is, a size of the oblong hole 32*b* in the longitudinal direction is larger than the outer diameter of the positioning pin.

Two pins 33 for adjustment in the Z direction are formed on the first side surface of each of the first and second base plates 30*a*, 30*b*. Incidentally, in FIG. 3, the pins 33 and grooves 34 (described below) of the second base plate 30*b* are omitted to simplify the drawing. Operations for adjustment of the holes 31*a*, 31*b*, 32*a* and 32*b* and the pins 33 will be described later.

The grooves 34 are formed in the second side surfaces of the first and second base plates 30*a*, 30*b* (see FIG. 2. However, FIG. 2 only shows the second base plate). The grooves 34 form air flow paths to promote heat radiation from the first and second base plates 30*a*, 30*b*.

As described above, the fixing member 40 fixes the piezoelectric member 10 to each of the first and second base plates 30*a*, 30*b*. The fixing member 40 has leaf springs 41 for elastically pressing the ink jet head to the first side surface of each of the first and second base plates 30*a*, 30*b*. The leaf springs 41 are arranged in both ends of each of the first and second base plates 30*a*, 30*b*. The leaf springs 41 elastically press and fix the piezoelectric member 10 onto each of the base plates 30*a* and 30*b* along the Y direction. The leaf springs 41 elastically press the piezoelectric member 10 of the ink jet head along the Y direction alone, and do not press it along the X direction in the drawing. Even if heat generated in the piezoelectric member 10 while the ink jet head 1 is driven causes the piezoelectric member 10 to expand along the X direction, the leaf springs 41 permits a change of the piezoelectric member 10 in size.

(Positioning and Sticking of Ink Jet Heads)

In the ink jet head unit IJHU, the two ink jet heads 1 are fixed after the two ink jet heads 1 are positioned by a positioning unit. The positioning unit includes an adjustment base 100, the cam member 102, a cam rotation mechanism 151 (see FIG. 5), a nozzle position detection means 152 (see FIG. 4), and a control portion 153 (see FIGS. 4 and 5). The adjustment base 100 has the two positioning pins 101 extending in the Y direction. The two positioning pins 101 are separated from each other by a predetermined distance and each has a diameter, so that the two positioning pins 101 can be inserted into the round holes 32*b*.

The cam member 102 has a round-bar portion 103 having a diameter substantially equal to that of the round hole 31*b*, and an eccentric cam portion 104 arranged roughly in a center of the round-bar portion 103 in a longitudinal direction thereof.

The cam rotation mechanism 151 is detachably connected to the cam member 102, and rotates the cam member 102 around a longitudinal axial center of the round-bar portion 103. The cam rotation mechanism 151 is connected to the control portion 153, and is driven by a driving instruction from the control portion 153.

The nozzle position detection means 152 is a well known detection means for detecting nozzle positions of each of the two ink jet heads 1. The nozzle position detection means 152 is connected to the control portion 153, and sends a result of the detection thereto.

The control portion 153 is a well-known control means for controlling a rotation of the cam rotation mechanism 151 based on the result of the detection from the nozzle position detection means 152.

Hereinafter, an assembling of the ink jet head unit IJHU will be described in more detail.

In the assembling, a positioning of the two ink jet heads 1 relative to each other and a fixing of them to each other are performed.

In the fixing, at first, the piezoelectric members 10 are fixed on the first and second base plates 30*a*, 30*b* by the fixing members 40. More specifically, as shown in FIG. 4, rear end surfaces (end surfaces opposite to the nozzle plates 20) 10*c* of the piezoelectric members 10 abut on the adjusting pins 33*a*, 33*b* of the first and second base plates 30*a*, 30*b*. With this abutment, positions of the piezoelectric members 10 in the Z-direction are defined with respect to the first and second base plates 30*a*, 30*b*. After this positioning, the piezoelectric members 10 are fixed on the first and second base plates 30*a*, 30*b* by the fixing members 40, and the positions of the piezoelectric members 10 in the Z-direction with respect to the first and second base plates 30*a*, 30*b* are established. In this embodiment, the piezoelectric members 10 are fixed on the first and second base plates 30*a*, 30*b* by pressing forces of the leaf springs 41 of the fixing members 40. And, other well-known fixing means such as an adhesive or screws can be used in place of the fixing members 40. However, it is preferable that the piezoelectric members 10 are fixed by the leaf springs 41 because the leaf springs 41 permit elongation and contraction of the piezoelectric members 10 by heat.

(Positioning in the Orthogonal Direction)

Subsequently, positioning in an orthogonal direction is performed in the fixing of the two ink jet heads 1. In this positioning in the orthogonal direction, the entire ink jet heads are positioned in the Z direction.

The first and second base plates 30*a*, 30*b* to which the piezoelectric members 10 have been fixed as described above are mounted on the adjustment base 100 shown in FIGS. 3 and 4 in a state in which the second side surfaces thereof are in contact with each other. At this time, the positioning pins 101 extending in the Y direction are inserted into the oblong holes 32*a* and the round holes 32*b*. In other words, the positioning pins 101 firstly penetrate the round holes 32*b* and then are inserted into the oblong holes 32*a*.

As described above, the diameter of each round hole 32*b* of the second base plate 30*b* is substantially equal to that of each positioning pin 101. Thus, the second base plate 30*b* is positioned with respect to the adjustment base 100 when the positioning pins 101 are inserted into the round holes 32*b*.

And, the size of each oblong hole 32*a* of the first base plate 30*a* in the short direction is substantially equal to the diameter of each positioning pin 101, as described above. Thus, the movement of each of the first and second base plates in the Z-direction is limited by the common positioning pins 101. That is, the positioning of each of the first and second base plates in the Z-direction is completed by the positioning pins 101.

Incidentally, the size of each oblong hole 32*a* in the longitudinal direction is larger than the diameter of each positioning pin 101. Thus, while the positioning pins 101 are inserted into the oblong holes 32*a*, the first base plate 30*a* can be moved in the nozzle arraying direction (X direction).

(Positioning in the Nozzle Arraying Direction)

Subsequently, positioning in a nozzle arraying direction is performed in the fixing of the two ink jet heads 1. In the positioning in the nozzle arraying direction, the entire ink jet heads are positioned in the X direction.

Specifically, in this positioning in the nozzle arraying direction, a position of the first base plate 30*a* in the X direction is adjusted. For this positioning, at first, the cam member 102 is inserted into the round holes 31*a*, 31*b* of the first and second base plates 30*a*, 30*b*. As described above, the diameter of the round hole 31*b* of the second base plate 30*b* is substantially equal to that of the round-bar portion 103 of the cam member 102. The round hole 31*a* formed in the first base plate 30*a* has a diameter to permit a insertion of the eccentric cam portion 104 of the cam member 102 into the round hole 31*a*. Accordingly, the cam member 102 can be rotated around the center axis of the round hole 31*b*, and the eccentric cam portion 104 is arranged in the round hole 31*a*. The eccentric cam portion 104 inserted into the round hole 31*b* configures a cam mechanism together with the round hole 31*b*.

After the insertion of the cam member 102, the cam rotation mechanism 151 is connected to the cam member 102 as shown in FIG. 5. When the cam member 102 is rotated around the center axis of the round hole 31*b*, the cam member 102 can move the first base plate 30*a* with respect to the second base plate 30*b*. Incidentally, the cam member 102 can be inserted into the round holes 31*a*, 31*b* after it is connected to the cam rotation mechanism 151.

After the arrangement of the cam member 102 is finished as described above, the nozzle position detection means 152 detects the positions of the nozzles of each of the ink ejecting portions mounted on the first and second base plates 30*a*, 30*b*. By this detection, a distance of relative shifting in the X direction between the nozzles of the two ink ejecting portions is detected.

Subsequently, the cam member 102 is rotated around the center axis of the round hole 31*b*. With this rotation, the first base plate 30*a* starts to move in the X direction. With this movement, the ink ejecting portion on the first base plate 30*a* is moved with respect to the ink ejecting portion on the second base plate 30*b*.

The movement of the first base plate 30*a* is limited in the X direction by guiding performance caused by the combination of the positioning pin 101 and the oblong hole 32*a*. A moving distance of the first base plate 30*a* corresponds to a rotational angle of the cam member 102 as described above. Thus, the position of the first base plate 30*a* with respect to the second base plate 30*b* can be finely adjusted more easily and accurately.

Additionally, an urging means for urging the ink jet head 1 in the X direction can be added to the above described nozzle arraying direction positioning unit. For example, as indicated by an arrow in FIG. 5, when the urging means urges the first base plate 30*a* toward the cam member 102, the first base plate 30*a* and the eccentric cam portion 104*a* are in intimately contact with each other. This intimate contact prevents a gap from generating between the first base plate 30*a* and the eccentric cam portion 104*a*. Thus, the cam member 102 can move the first base plate 30*a* highly accurately. The urging means can be configured by an elastic member such as rubber or a spring to provide an urging force, or configured to urge the first base plate 30*a* mechanically.

During or after this movement, the nozzle position detection means detects the distance of the shifting between each nozzle of one ink ejecting portion and that of the other ink ejecting portion. When the shifting distance reaches ½ of the one pitch P in the nozzles 20*a* of the ink ejecting portion, the control portion 153 stops the driving of the cam rotation mechanism 151, whereby the movement is stopped.

That is, when nozzle arrays of the two ink ejecting portions are shifted from each other by ½ of the one pitch, the positioning of the two ink ejecting portions in the X-direction is completed.

After the completion of this positioning, the first and second base plates 30*a*, 30*b* and the cam member 102 are integrally fixed by an adhesive. For the adhesive used here, a well-known adhesive such a UV cure type or an epoxy type may be used.

The first and second base plates 30*a*, 30*b* can be fixed by well-known methods other than the adhesive, e.g., screws.

A size between the front end face 10*b* (nozzle plate 20 strictly speaking) and the rear end face 10*c* in the piezoelectric member 10 of the ink jet head 1 is set with a very high accuracy. Thus, a long as the sizes in the Z-direction of the pins 33, the two oblong holes 32*a*, and the two round holes 32*b* on the first and second base plates 30*a*, 30*b* are strictly set, the Z-direction positioning of each ink jet head 1 can be highly accurately performed only by abutting the rear end face 10*c* of the piezoelectric member of each ink jet head 1 on the pins 33.

After the adhesion of the first and second base plates 30*a*, 30*b* and the cam member 102 is finished, the flexible substrates 18 of the ink jet heads 1 are made to adhere to the first and second base plates 30*a*, 30*b*.

As described above, in the two existing ink jet heads 1, the ink ejecting portions are fixed to the first and second base plates 30*a*, 30*b*. After the fixing, the two ink jet heads 1 can be positioned in the Z and X directions by the two positioning pins 101 which are common positioning members and the cam member 102. That is, no individual positioning members are used for positioning each ink jet head 1. Thus, different from the case in which individual positioning members are used for positioning each ink jet head 1, the common positioning members need not perform positioning for each ink jet head. Therefore, the positioning using the common positioning members can be performed highly accurately as compared to the case in which individual positioning members are used for positioning each ink jet head 1. Thus, with the ink jet head unit assembling method of the embodiment, the positioning of the two existing ink jet heads can be performed easily and highly accurately.

Additionally, the two ink jet heads 1 are stuck and fixed to each other after this positioning. Thus, with the ink jet head unit assembling method of the embodiment, it is possible to highly accurately provide an ink jet head unit IJHU for a high-density recording by using the existing ink jet heads.

Furthermore, after fixing with the adhesive, both ends of the round-bar portion 103 of the cam member 102 are projected from the round holes 31*a* and 31*b* along the Y direction. The projected both ends of the round-bar portion 103 can be used as positioning pins when the ink jet head unit IJHU is mounted to the image recording apparatus. Since the cam member 102 is a member for directly positioning the nozzles, the position of the cam member 102 with respect to the ink jet heads 1 is highly accurately set. Thus, the cam member 102 enables highly accurate positioning of the ink jet head unit IJHU to the image recording apparatus. As described above, since the ink jet head unit IJHU can use the cam member 102 for positioning the ink jet head unit IJHU with respect to the image recording apparatus, there is no need to directly use the piezoelectric member 10 during the positioning of the ink jet head unit IJHU with respect to the image recording apparatus. As a result, it is possible to prevent an excessive force from applying on the piezoelectric member 10 during the positioning of the ink jet head unit IJHU with respect to the image recording apparatus, and a damaging or shifting of the piezoelectric member 10 during the positioning is also prevented.

[Second Embodiment]

Next, an ink jet head unit IJHU according to a second embodiment will be described with reference to FIGS. 10 to 12.

(Constitution)

Figure 10:
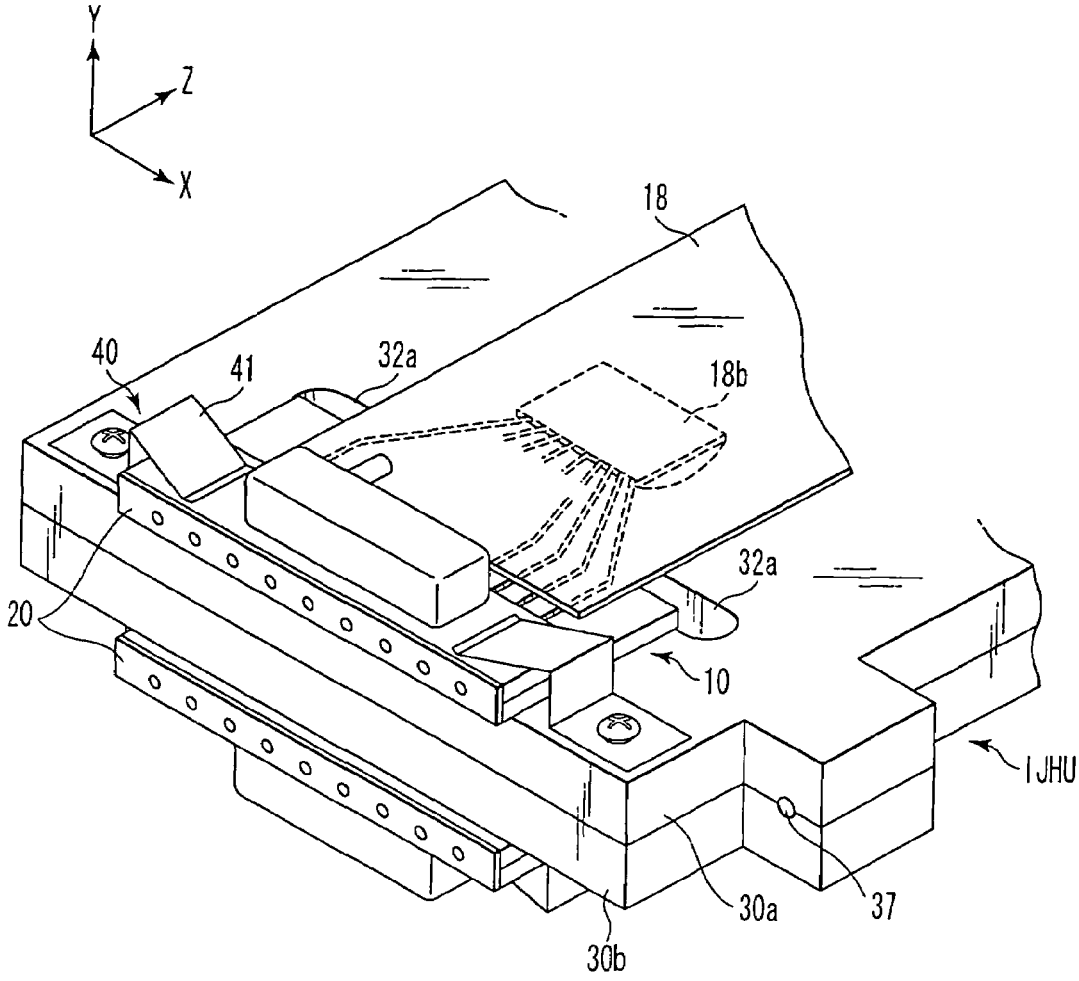
FIG. 10 is a perspective view of an ink jet head unit according to a second embodiment.

FIG. 10 is a perspective view of the ink jet head unit according to the embodiment. FIG. 11 is a sectional view showing ink jet heads 1 of FIG. 10 while a positional adjustment between them in a Z direction is performed. FIG. 12 is a partially sectioned front view of the ink jet heads 1 of FIG. 10 while a positional adjustment between base plates of them in an X direction is performed. In this embodiment, components similar to those in the first embodiment are denoted by the same reference numerals as those denoting the similar components in the first embodiment, and descriptions thereof will be omitted.

The ink jet head unit IJHU of the embodiment is different from that of the first embodiment in the following constitution. In the ink jet head unit IJHU of the embodiment, no pins for Z-direction positioning are formed on the first and second base plates 30*a*, 30*b*. No round holes into which a cam member 102 for X-direction position adjustment is inserted are formed. Further, a size of each of the two oblong holes 32*a* and round hole 32*b* for X-direction position adjustment in the short direction (Z direction in FIG. 10) are larger than the diameter of each of the two positioning pins 101 formed on the adjustment base 100 (described later).

(Positioning and Sticking of Ink Jet Heads)

In this embodiment, the two ink jet heads 1 are fixed as in the case of the first embodiment. In this fixing, at first, the ink ejecting portions are fixed on the first and second base plates 30*a*, 30*b* by the fixing members 40. When the ink ejecting portions are fixed on the first and second base plates 30*a*, 30*b*, a potion of each piezoelectric member 10 located near to the other end (the rear end face 10*c*) partially cover the openings of the oblong holes 32*a* and the round hole 32*b* for the X-direction position adjustment.

Next, the first and second base plates 30*a*, 30*b* are mounted on the adjustment base 100 in a state in which the second side surfaces thereof are in intimately contact with each other. At this time, the two positioning pins 101 of the adjustment base 100 penetrate the round holes 32*b* and then are inserted into the oblong holes 32*a*, as in the case of the first embodiment.

(Positioning in the Orthogonal Direction)

In this positioning, a position of each ink jet head 1 is adjusted in a direction (Z direction) orthogonal to a nozzle arraying direction.

Figure 11:
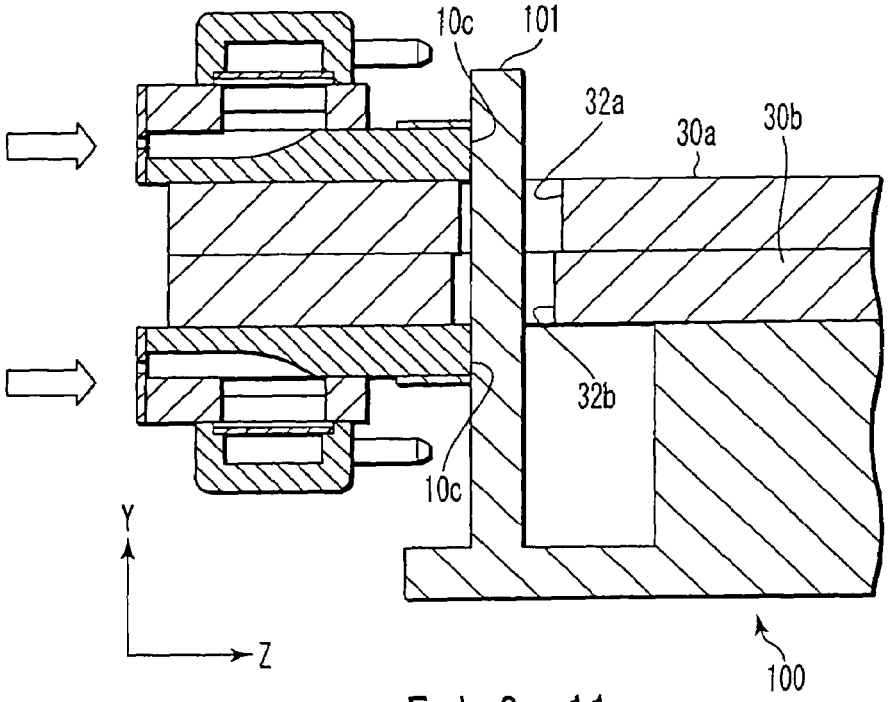
FIG. 11 is a sectional view showing ink jet heads of FIG. 10 while a positional adjustment between them in a Z direction is performed.

In this positioning, after the first and second base plates 30*a*, 30*b* are placed on the adjustment base 100, the first and second base plates 30*a*, 30*b* are moved in the Z direction (an arrow direction in FIG. 11) so that the rear end faces 10*c* of the piezoelectric members 10 abut on the positioning pins 101 (see FIG. 11).

As shown in FIG. 11, in this embodiment, the Z-direction positioning is not performed by directly using the first and second base plates 30*a*, 30*b*. Instead of this, in this embodiment, the rear end faces 10*c* of the piezoelectric members 10 are abutted on the two positioning pins 101 which are common members. By this abutment, the Z-direction positioning of the piezoelectric members 10, i.e., the ink jet heads 1, is performed. A size from the front end face 10*b* (nozzle plate 20 strictly speaking) of the piezoelectric member 10 to the rear end face 10*c* thereof is strictly set with a very high accuracy during manufacturing of the ink jet head 1. Thus, the nozzle plate 20 of the piezoelectric member 10 of the first ink jet head (upper one in FIG. 11) and the nozzle plate 20 of the piezoelectric member 10 of the second ink jet head (lower one in FIG. 11) can be easily matched with each other in their positions in the Z direction.

(Positioning in the Nozzle Arraying Direction)

After the rear end faces 10*c* of the piezoelectric members 10 are abutted on the positioning pins 101, positioning in the nozzle arraying direction is performed. In this positioning, the position of each ink jet head 1 is adjusted in the nozzle arraying direction (X direction). At first, the first base plate 30*a* is moved in the X direction by the cam member 102. The cam member 102 of this embodiment is rotationally disposed on the adjustment base 100 and is brought into contact with side end faces 38*a*, 38*b* of the first and second base plates 30*a*, 30*b*. Specifically, the eccentric cam portion 104 abuts on the side end face 38*a* of the first base plate 30*a*, and the round-bar portion 103 abuts on the side end face 38*b* of the second base plate 30*b* (see FIG. 12).

Figure 12:
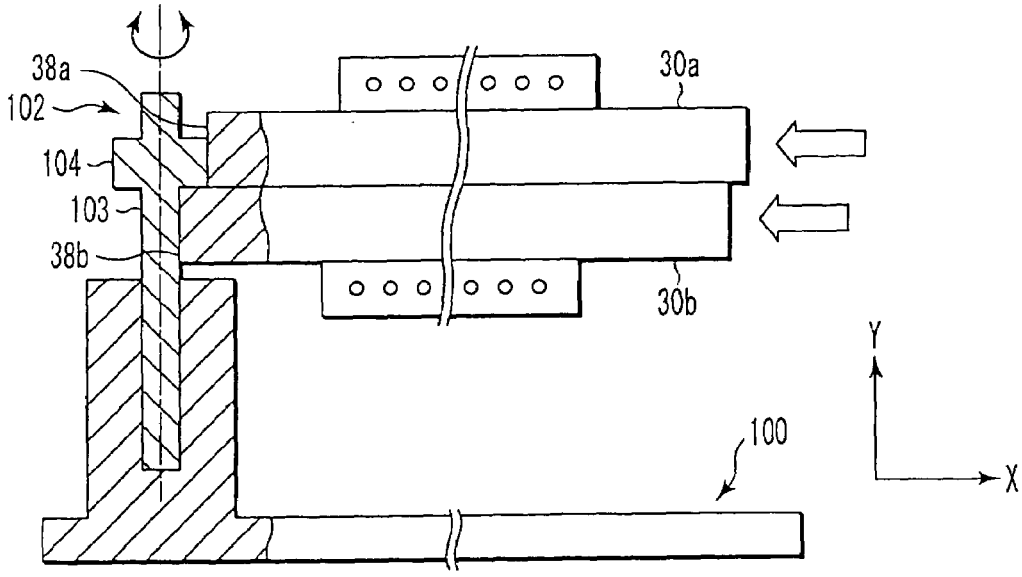
FIG. 12 is a partially sectioned front view of the ink jet heads of FIG. 10 while a positional adjustment between base plates of them in an X direction is performed.

In this embodiment, as indicated by arrows in FIG. 12, the first and second base plates 30*a*, 30*b* are urged toward the cam member 102 by urging means (not shown) similar to that of the first embodiment. When the side end face 38*b* of the second base plate 30*b* abuts on the round-bar portion 103 of the cam member 102, the X-direction positioning of the second base plate 30*b* is finished.

Next, each nozzle position of the ink ejecting portion mounted on the first base plate 30*a* is adjusted by moving the first base plate 30*a* as in the case of the first embodiment. The first base plate 30*a* is moved by rotating the cam member 102 as in the case of the first embodiment. With this fine adjustment, each nozzle position of the ink ejecting portion on the first base plate 30*a* is shifted by ½ of the one pitch P from that of the ink ejecting portion mounted on the second base plate 30*b*.

Like in the case of the first embodiment, after the nozzle position of the first ink jet head 1 is shifted from that of the second ink jet head 1 by ½ of the one pitch P, the first and second base plates 30*a*, 30*b* are fixed to each other by an adhesive. For the adhesive, a well-known adhesive such a UV cure type or an epoxy type used for adhering an aluminum member may be used. The above described fixing can be performed by fixing members such as screws in place of the adhesive.

In this embodiment, the Z-direction positioning of the two ink jet heads is performed by directly abutting the rear end faces 10*c* of the piezoelectric members 10 on the common positioning pins 101. Thus, with this assembling method of the embodiment, it is possible to perform highly accurate positioning of the two ink jet heads because the piezoelectric members 10 can be directly positioned without using other members.

[Third Embodiment]

Next, an ink jet head unit IJHU according to a third embodiment will be described with reference to FIGS. 13 to 18.

(Constitution)

Figure 13:
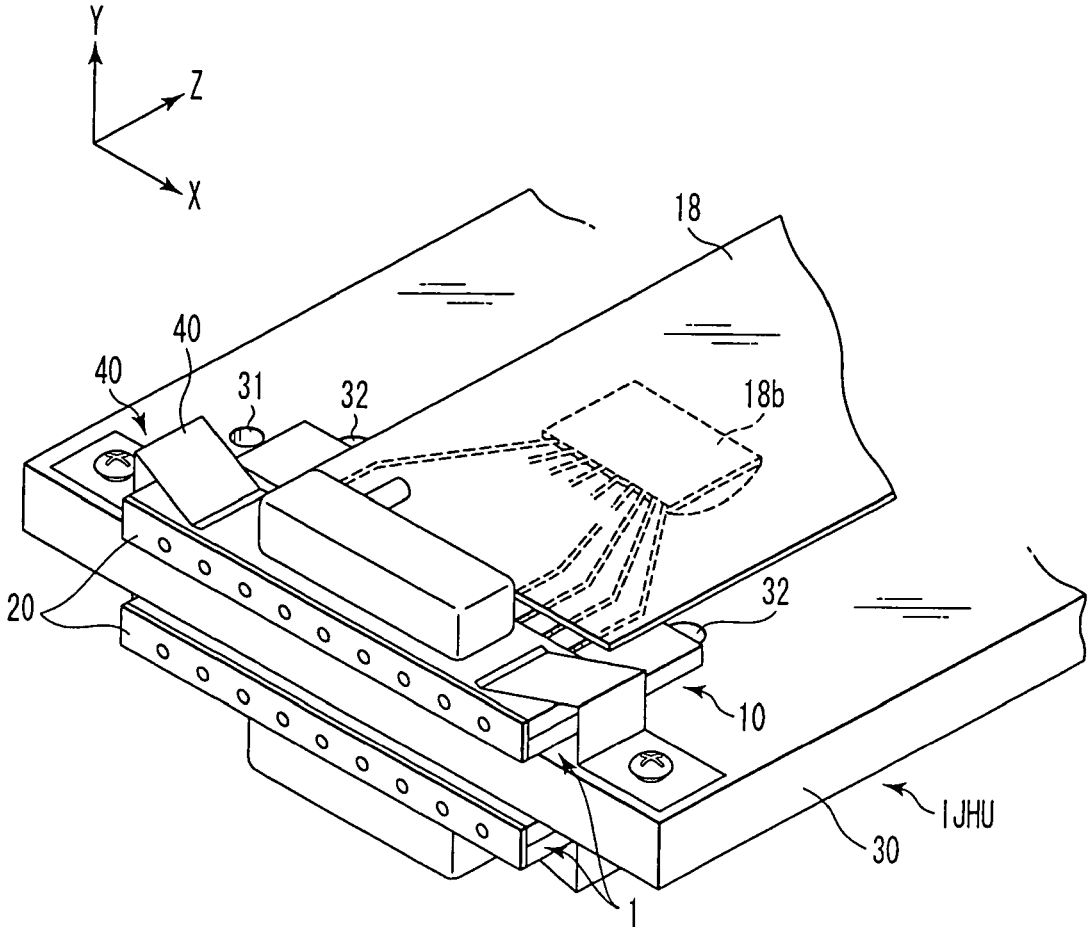
FIG. 13 is a perspective view of an ink jet head unit according to a third embodiment.
Figure 14:
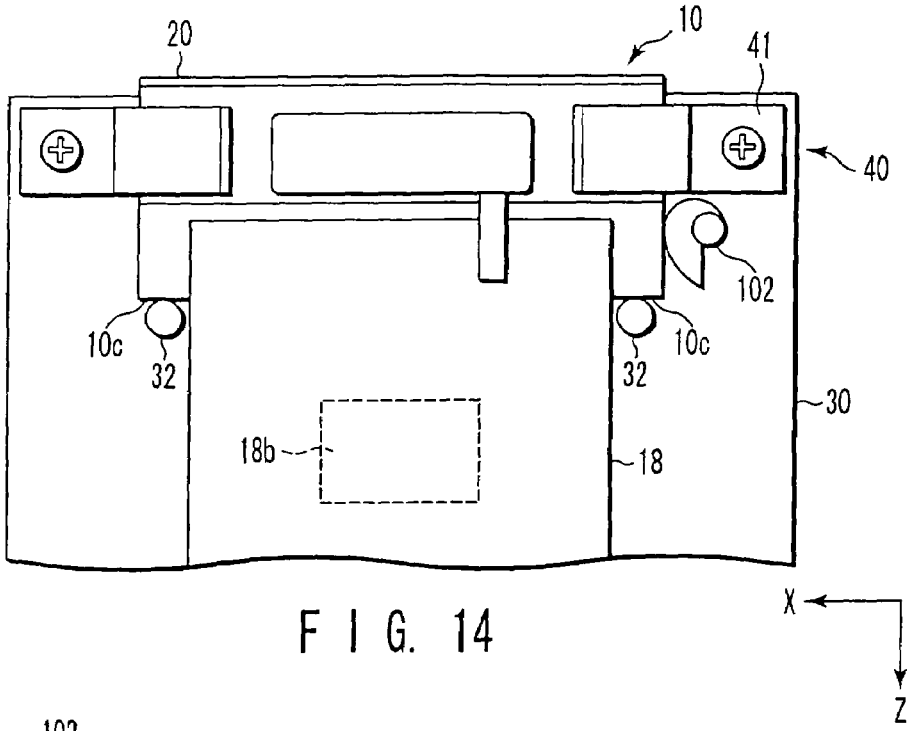
FIG. 14 is a top view of the ink jet head unit of FIG. 13.
Figure 15:
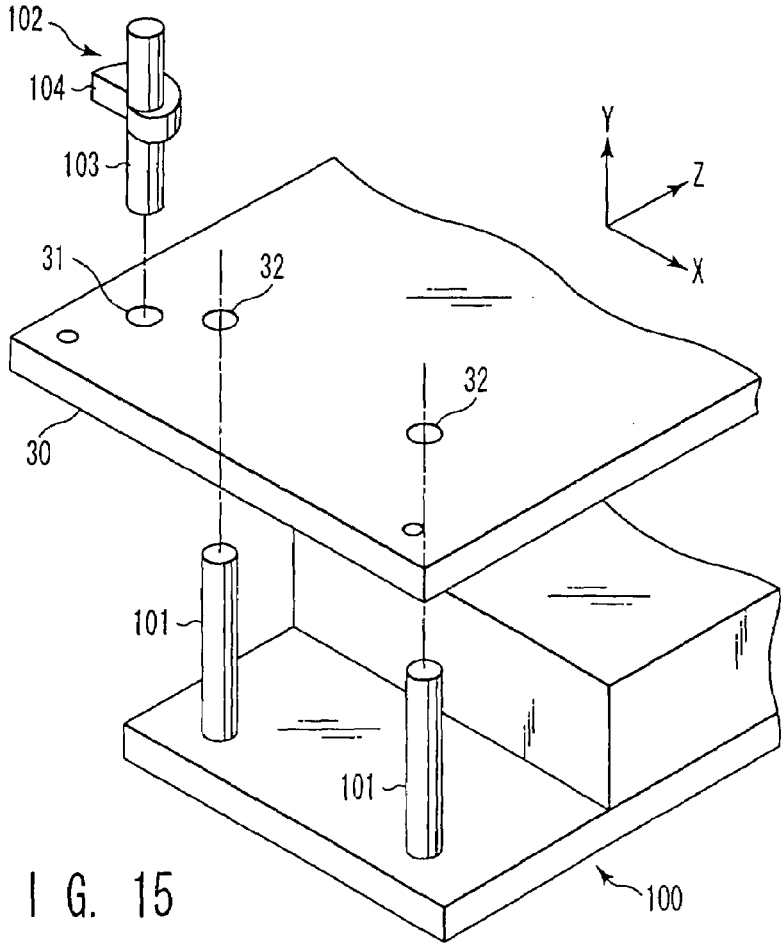
FIG. 15 is a perspective view showing a positional relation among a base plate, an adjustment base, and a cam member in the ink jet head unit of FIG. 13.
Figure 16:
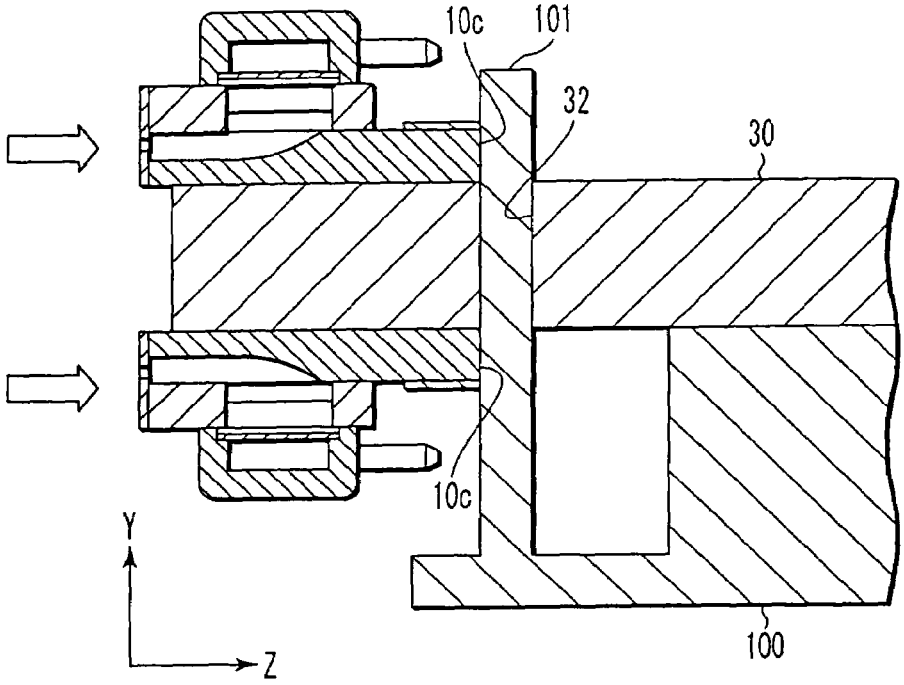
FIG. 16 is a sectional view showing ink jet heads of FIG. 13 while a positional adjustment between them in a Z direction is performed.
Figure 17:
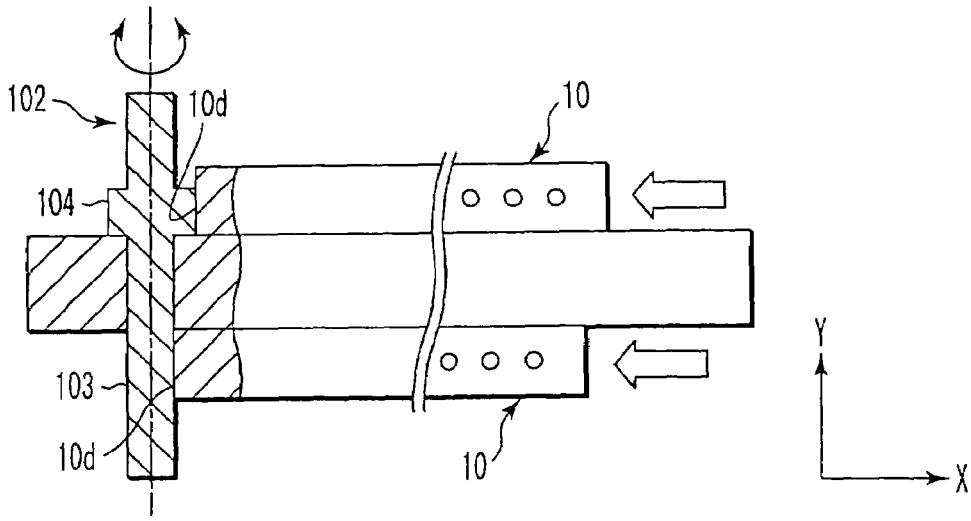
FIG. 17 is a partially sectioned front view of the ink jet heads of FIG. 13 while a positional adjustment between them in an X direction is performed.
Figure 18:
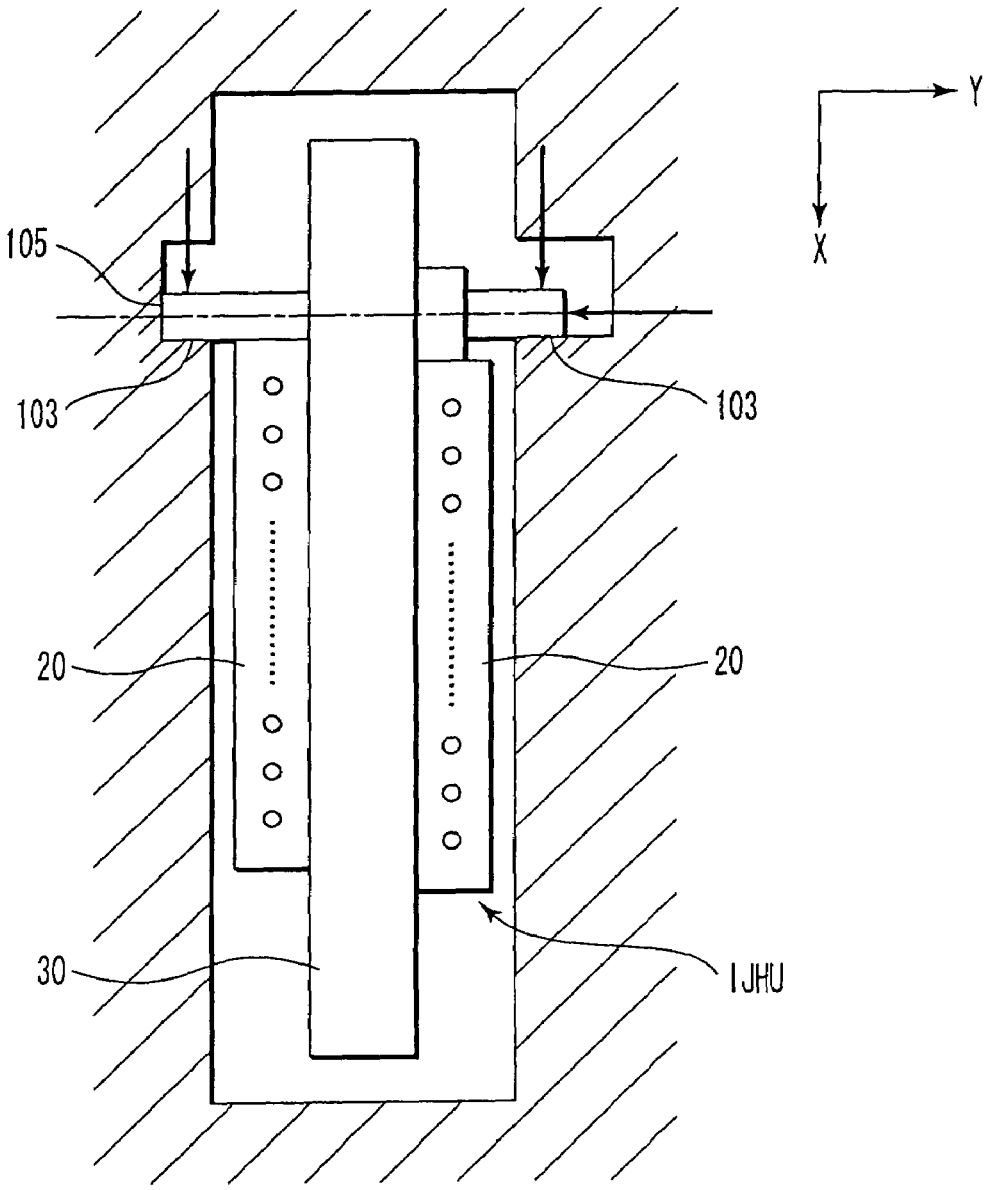
FIG. 18 is a schematic view showing the ink jet head unit of FIG. 13 mounted to an image recording apparatus.

FIG. 13 is a perspective view of the ink jet head unit IJHU of this embodiment. FIG. 14 is a top view of the ink jet head unit IJHU of FIG. 13. FIG. 15 is a perspective view showing a positional relation among a base plate, an adjustment base, and a cam member in the ink jet head unit IJHU of FIG. 13. FIG. 16 is a sectional view showing ink jet heads of FIG. 13 while a positional adjustment between them in a Z direction is performed. FIG. 17 is a partially sectioned front view of the ink jet heads of FIG. 13 while a positional adjustment between them in an X direction is performed. FIG. 18 is a schematic view showing the ink jet head unit of FIG. 13 mounted to an image recording apparatus.

The ink jet head unit IJHU of this embodiment is different from that of the first embodiment in the following constitution. The ink jet head unit IJHU of this embodiment only has one common base plate 30 for two ink ejecting portions. That is, each ink jet head 1 of this embodiment does not have each individual base plate. A first ink jet head (upper one in FIG. 13) is fixed to an upper or first side surface of the base plate 30, and a second ink jet head (lower one in FIG. 13) is fixed to a lower or second side surface thereof. Each of the first and second ink jet heads has an ink ejecting portion similar to that of the first embodiment.

No positioning pins for Z-direction position adjustment are formed on the base plate 30. The base plate 30 has two round holes 32 into which the positioning pins 101 are inserted. The base plate 30 further has a hole 31 into which the cam member 102 is inserted. This hole 31 is formed to have a size to allow an insertion of the round-bar portion 103 alone therein.

(Positioning and Sticking of Ink Jet Heads)

In this embodiment, the two ink jet heads 1 are fixed as in the case of the first embodiment. In this fixing, at first, the base plate 30 is placed on the adjustment base 100. At this time, the two positioning pins 101 formed on the adjustment base 100 are inserted into the holes 32 for inserting positioning pins (see FIG. 15).

(Positioning in the Orthogonal Direction)

In this positioning, a position of each ink jet head 1 is adjusted in the Z direction. In this positioning, the two ink jet heads 1 are temporarily fixed to the upper or first side surface and the lower or second side surface of the base plate 30. The temporary fixing is performed in a state in which the rear end faces 10*c* of the piezoelectric members 10 of the two ink jet heads 1 abut on the positioning pins 101 of the adjustment base 100 (see FIG. 16). In this temporarily fixing, each ink jet head 1 is moved relatively freely with respect to the base plate 30.

The positions of the two ink jet heads 1 in the Z-direction coincide with each other by abutting the rear end faces 10*c* of the piezoelectric members 101 on the common positioning pins 101.

(Positioning in the Nozzle Arraying Direction)

In this positioning, the positions of the temporarily fixed ink jet heads 1 are adjusted in the nozzle arraying direction (X direction). As shown in FIG. 17, each of the two ink jet heads 1 is urged in the direction indicating by an arrow along the nozzle arraying direction by the urging means similar to that of the first embodiment. As a result, the first and second ink jet heads 1 abut on the cam member 102. More specifically, a side end face 10*d* of the piezoelectric member 10 of the second ink jet head (lower one) abuts on the round-bar portion 103 of the cam member 102, and a side end face 10*d* of the piezoelectric member 10 of the first ink jet head (upper one) abuts on the eccentric cam portion 104 of the cam member 102.

The second ink jet head 1 is fixed to the base plate 30 by the fixing members 40 after the rear end face 10*c* of the piezoelectric member 10 abuts on the two positioning pins 101 and the side end face 10*d* thereof abuts on the round-bar portion 103 of the cam member 102. That is, the second ink jet head 1 is fixed to the base plate 30 after the positioning of the second ink jet head 1 in the X and Z-directions are performed by using the positioning pins 101 and cam member 102 of the position adjustment unit.

Next, the position of each ink jet head 1 is adjusted in the nozzle arraying direction (X direction). This position adjustment is performed by rotating the cam member 102. With this rotation of the cam member 102, the first ink jet head 1 can be moved in the X direction with respect to the second ink jet head 1 as in the case of the first-embodiment. Further, in this position adjustment, like in the case of the first embodiment, the first ink jet head 1 is moved just a little in the X direction with respect to the second ink jet head 1 so that each nozzle position of the first ink jet head 1 is shifted from that of the second ink jet head 1 by a half of the one nozzle pitch P.

After each nozzle position of the first ink jet head 1 is shifted from that of the second ink jet head 1 by a half of the one nozzle pitch P, the first ink jet head 1 is also fixed to the base plate 30 by the fixing members 40.

Further, after the X-direction positioning of each of the two ink jet heads 1 is finished, the cam member 102 is fixed to the base plate 30 by an adhesive. The two flexible substrates 18 extended from the ink jet heads 1 are also fixed to the base plate 30 by the adhesive.

In this ink jet head unit assembling method of the embodiment, the two existing ink jet heads are positioned by the common positioning unit and then stuck and fixed to each other. Therefore, with the ink jet head unit assembling method of the embodiment, it is possible to highly accurately form an ink jet head unit IJHU for a high-density recording.

Beside, in this embodiment, the rear end face 10*c* and the side end face 10*d* of the piezoelectric member 10, the sizes of which are strictly set, are abutted on the two positioning pins 101 and cam member 102 which are the common positioning unit. Then, with this abutment, the position of each of the two ink jet heads 1 is adjusted in the Z and X directions. As described above, since the positioning of each of the two ink jet heads 1 is performed directly through each piezoelectric member 10 the size of which is strictly set, the assembling method brings a very high accuracy of a relative positional relation between each nozzle position of one ink jet head 1 and that of the other ink jet head 1.

Like in the case of the first embodiment, when the ink jet head unit IJHU of the embodiment is mounted to the image recording apparatus, the cam member 102 adhered to the base plate 30 can be used as a positioning member for positioning the ink jet head unit IJHU to the image recording apparatus. In this embodiment, the cam member 102 functions as an X and Y-direction positioning member.

That is, as shown in FIG. 18, the positioning of the ink jet head unit IJHU in the Y-direction to the image recording apparatus is performed by using an end surface 105 of the cam member 102. Further, a cylindrical surface of the round-bar portion 103 of the cam member 102 can be used for performing the positioning of the ink jet head unit IJHU in the X-direction to the image recording apparatus.

That is, as shown in FIG. 18, the positioning of the ink jet head unit IJHU in the Y-direction to the image recording apparatus is performed by using the end surface 105 of the cam member 102, and the positioning of the ink jet head unit IJHU in the X-direction to the image recording apparatus is performed by using the cylindrical surface of the round-bar portion 103 of the cam member 102.

[Fourth Embodiment]

Figure 19:
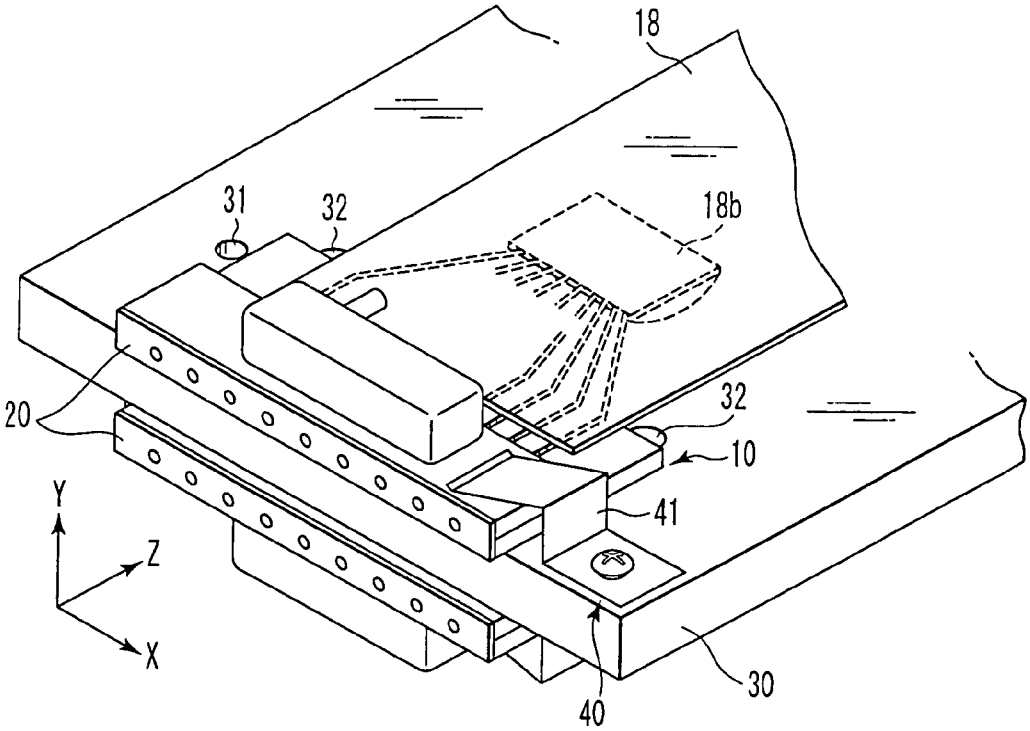
FIG. 19 is a perspective view of an ink jet head unit according to a fourth embodiment.

Next, an ink jet head unit IJHU according to a fourth embodiment will be described with reference to FIGS. 19 and 20.

The ink jet head unit IJHU of this embodiment is different from that of the third embodiment in that one end portion of the piezoelectric member of each ink jet head is fixed to the base plate 30 by an adhesive, and the other end portion thereof is elastically pressed and fixed by the leaf spring 41 to the base plate 30.

There is a case that the piezoelectric member 10 is adhered to the base plate 30 by an adhesive applied on whole of the bottom surface (which is stuck to the base plate 30). In this case, when heat is generated in the piezoelectric member 10 and the piezoelectric member 10 is elongated and contracted by the heat, a great stress is generated in the piezoelectric member 10 due to a difference in coefficient of thermal expansion between a material of the piezoelectric member 10 and a material of the base plate 30. Such a great stress may cause a deformation or breakage of the piezoelectric member 10. In order to avoid such a problem, in this embodiment, the adhesive is not applied on the whole of the bottom surface of the piezoelectric member 10 but applied only on a part of the bottom surface.

Figure 20:
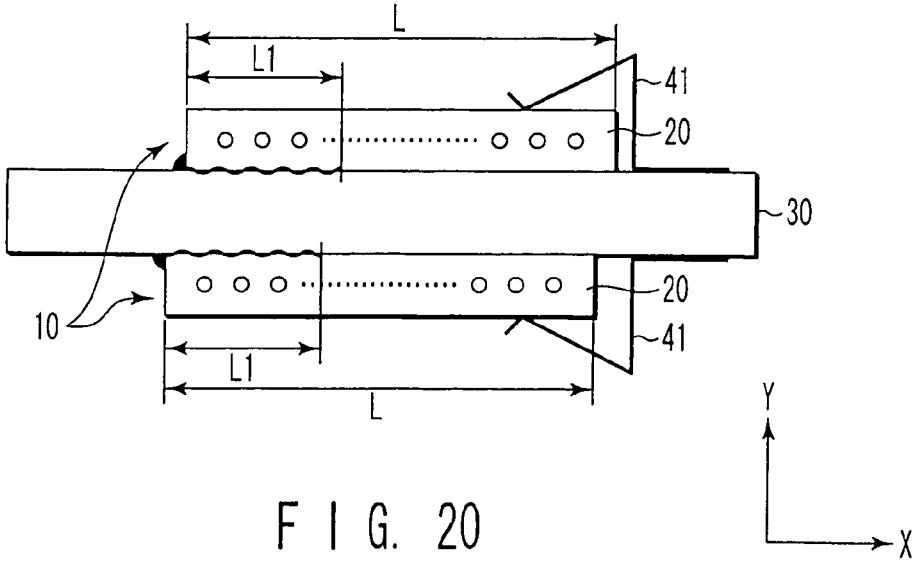
FIG. 20 is a view showing the ink jet head unit of FIG. 19 from a nozzle plate side.

In this embodiment, the adhesive is applied only on a one end portion of the bottom surface of the piezoelectric member 10 in the nozzle arraying direction, as indicated by a wavy line in FIG. 20. And, when an area on which the adhesive is applied is set equal to or lower than about ¼ of the entire area of the bottom surface of the piezoelectric member 10, the following technical advantage is provided. That is, the stress applied on the piezoelectric member 10 by its thermal expansion can be reduced while an influence caused by the position shifting thereof with the thermal expansion is reduced. In this embodiment, as shown in FIG. 20, the adhesive is applied on the bottom surface of the piezoelectric member 10 within a range of a size L1 which is from the one end of the piezoelectric member 10 to a position about ⅓ of an entire size L of the piezoelectric member 10 in the nozzle arraying direction.

Furthermore, it is preferable that the adhesive application portion ranging with the size L1 on the piezoelectric member 10 of the first ink jet head 1 (upper one) and the adhesive application portion ranging with the size L1 of the piezoelectric member 10 of the second ink jet head (lower one) are arrange in the same side (left side in FIG. 20) as to each other when the first and second ink jet heads 1 are seen from the side of the nozzle plates 20. With such arrangement, expanding directions of the piezoelectric members 10 of the first and second ink jet heads 1 coincide with each other when the piezoelectric members 10 are thermally expanded. Accordingly, even if the piezoelectric members 10 are thermally expanded, a relative relation between each nozzle position of one ink jet head 1 and that of the other ink jet head 1 can be maintained. For example, the sift of each nozzle position of the first ink jet head from that of the second ink jet head in the X direction is maintained at about ½ of the one pitch P after the first and second ink jet heads 1 are thermally expanded.

[Fifth Embodiment]

Next, an ink jet head unit IJHU according to a fifth embodiment will be described with reference to FIGS. 21 to 23.

(Constitution)

Figure 21:
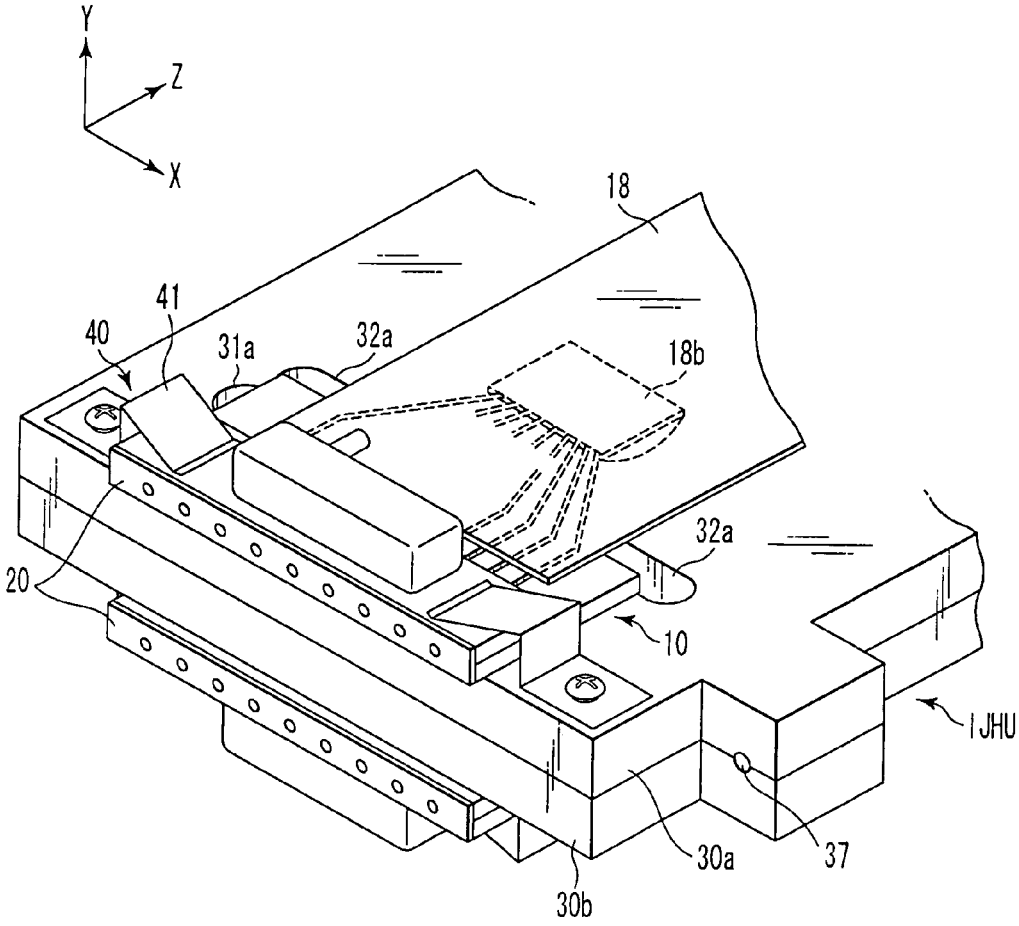
FIG. 21 is a perspective view of an ink jet head unit according to a fifth embodiment.

FIG. 21 is a perspective view of the ink jet head unit IJHU of this embodiment. FIG. 22 is a sectional view showing ink jet heads of FIG. 21 while a positional adjustment between them in a Z direction is performed. FIG. 23 is a partially sectioned front view of the ink jet heads of FIG. 21 while a positional adjustment between them in an X direction is performed.

The ink jet head unit IJHU of the embodiment is different from that of the first embodiment in the following constitution. In the ink jet head unit IJHU of this embodiment, no pins 33 for Z-direction positioning are formed on the first and second base plates 30*a*, 30*b*. Additionally, a size of each of the two oblong holes 32*a* and round hole 32*b* for X-direction position adjustment in a short direction (Z direction) is larger than the diameter of each of the positioning pins 101 of the adjustment base 100. The diameters of the round holes 31*a*, 31*b* into which the cam member 102 is inserted are set equal to each other, and each diameter is set sufficiently larger than that of the round-bar portion 103 of the cam member 102.

(Positioning and Sticking of the Ink Jet Heads)

In this embodiment, the two ink jet heads 1 are fixed as in the case of the first embodiment. In this fixing, at first, the ink ejecting portions are fixed on the first and second base plates 30*a*, 30*b* by the fixing members 40. When the ink ejecting portions are fixed to the first and second base plates 30*a*, 30*b*, the portion of each piezoelectric member 10 located near to the other end (the rear end face 10*c*) is arranged to partially cover the openings of the oblong holes 32*a* and round hole 32*b*. Further, a side portion of each piezoelectric member 10 located near to the side end face 10*d* is arranged to partially cover the opening of each round hole 31*a*, 31*b* for X-direction position adjustment.

Next, the two ink jet heads 1 are placed on the adjustment base 100 in a state in which the bottom or second side surfaces of the first and second base plates 30*a*, 30*b* are firmly stuck to each other. At this time, the two positioning pins 101 of the adjustment base 100 penetrate the round hole 32*b* and are inserted into the oblong holes 32*a*, as in the case of the first embodiment.

(Positioning in the Orthogonal Direction)

With this embodiment, the positioning of the two ink jet heads 1 in the orthogonal direction is performed after the first and second base plates 30*a*, 30*b* are placed on the adjustment base 100 as described above. In this positioning, each of the first and second base plates 30*a*, 30*b* is moved in the Z direction (the arrow direction in FIG. 22) so that the rear end face 10*c* of each piezoelectric member 10 abuts on the positioning pins 101 (see FIG. 22).

Figure 22:
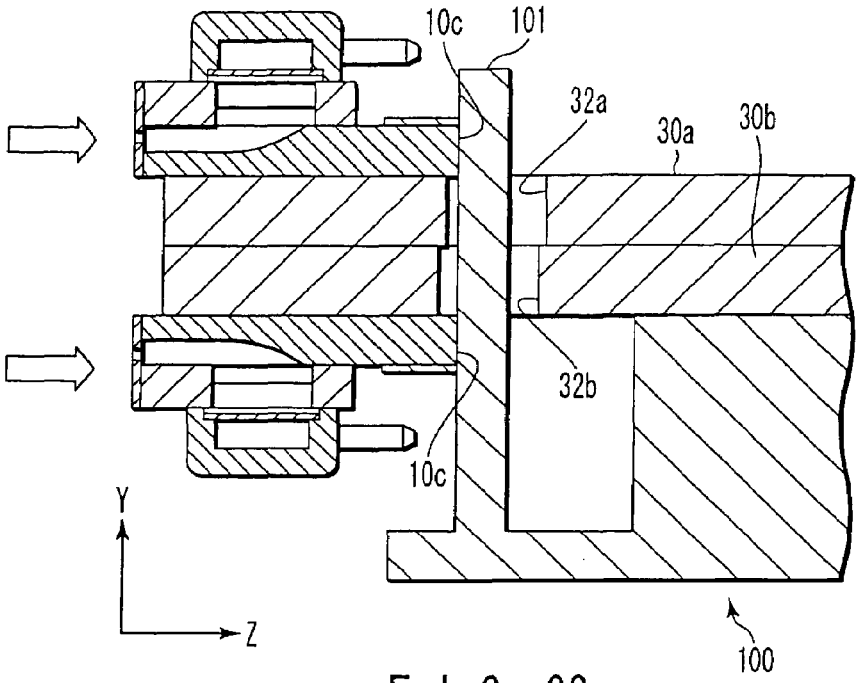
FIG. 22 is a sectional view showing ink jet heads of FIG. 21 while a positional adjustment between them in a Z direction is performed.

As shown in FIG. 22, in this embodiment, the Z-direction positioning of each ink ejecting portion 1 is performed by using not each of the first and second base plates 30*a*, 30*b* but each piezoelectric member 10. More specifically, in this embodiment, the Z-direction positioning of each ink ejecting portion 1 is performed by abutting the rear end face 10*c* of each piezoelectric member 10 on the two common positioning pins 101. By this positioning of each piezoelectric member 10, the positioning of each ink jet head 1 in the Z-direction is finished. The size of the piezoelectric member 10 from the front end face 10*b* (nozzle plate 20 strictly speaking) to the rear end face 10*c* is strictly set with a very high accuracy during manufacturing of the ink jet head 1. Thus, the position of the nozzle plate 20 of the first ink jet head 1 (upper one in FIG. 22) in the Z direction and that of the second ink jet head 1 (lower one in FIG. 22) in the Z direction can be easily matched with each other by abutting the piezoelectric members 10 of the first and second ink jet heads 1 on the positioning pins 101 which are the common positioning members.

(Positioning in the Nozzle Arraying Direction)

After the positioning in the orthogonal direction, the positioning in the nozzle arraying direction is performed. More specifically, this positioning is performed after the rear end faces 10*c* of the piezoelectric members 10 abut on the positioning pins 101. In this positioning, as in the case of the first embodiment, one ink jet head 1 is moved in the X direction with respect to the other ink jet head 1. Incidentally, in this embodiment, the first ink jet head 1 (upper one in FIG. 23) together with the first base plate 30*a* is moved in the nozzle arraying direction (X direction) by the cam member 102.

Figure 23:
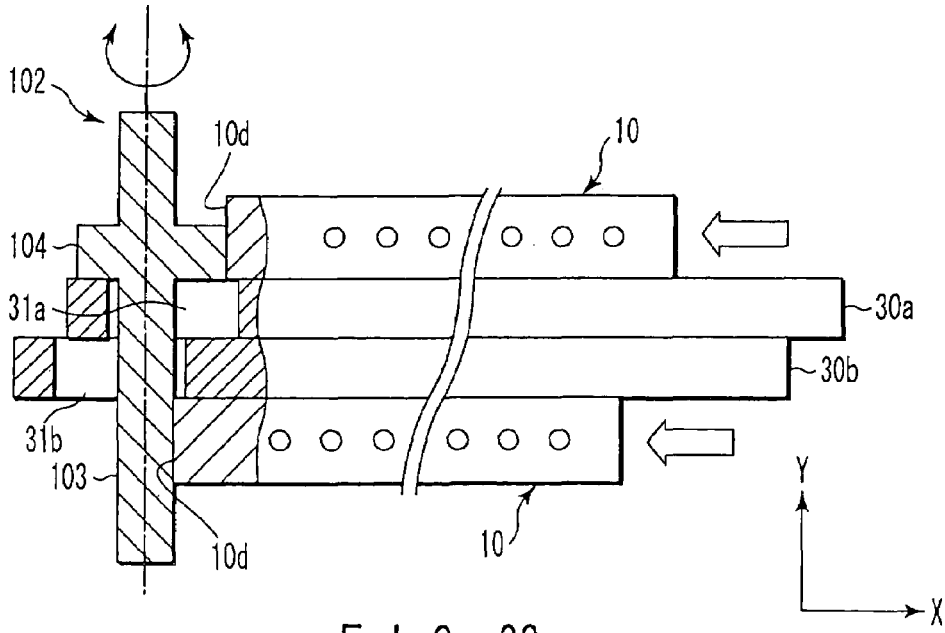
FIG. 23 is a partially sectioned front view of the ink jet heads of FIG. 21 while a positional adjustment between them in an X direction is performed.

As shown in FIG. 23, the two ink jet heads 1 are urged in the arrow direction along the X direction by the urging means similar to that in the first embodiment. As a result, the side end face 10*d* of the piezoelectric member 10 of the second ink jet head (lower one) abuts on the round-bar portion 103 of the cam member 102, and the side end face 10*d* of the piezoelectric member 10 of the first ink jet head (upper one) abuts on the eccentric cam portion 104 of the cam member 102.

In this embodiment, the cam member 102 is used for the position adjustments of the first and second ink jet heads 1 in the nozzle arraying direction (X direction). When the cam member 102 is rotated, the piezoelectric member 10 of the first ink jet head 1 is moved in the X direction with the rotation of the cam member 102. Also in this embodiment, as in the case of the first embodiment, each nozzle position of the first ink jet head 1 is adjusted with respect to that of the second ink jet head so that each nozzle position of the first ink jet head 1 is shifted from that of the second ink jet head by a half of the one pitch P.

After the first ink jet head 1 is moved as described above and each nozzle position of the first ink jet head 1 is shifted from that of the second ink jet head by a half of the one pitch P, the first and second base plates 30*a*, 30*b* are fixed to each other by an adhesive.

Further, the cam member 102 is adhered to the first and second base plates 30*a*, 30*b* by an adhesive after the positioning of the two ink jet heads 1 in the X direction is finished. Additionally, the two flexible substrates 18 extended from the ink jet heads 1 are also adhered to the first and second base plates 30*a*, 30*b* by an adhesive.

As described above, in the ink jet head unit assembling method of the embodiment, the two existing ink jet heads are positioned by the common positioning unit, and then stuck and fixed to each other. Therefore, with the ink jet head unit assembling method of this embodiment, it is possible to highly accurately form the ink jet head unit IJHU for a high-density recording.

Further, in the assembling method of this embodiment, the position adjustments of the two ink jet head in the Z and X-direction are performed by abutting the rear end faces 10*c* and side end faces 10*d* of the piezoelectric members 10, the size of each of which is strictly set, on the two positioning pins 101 and cam member 102 which are the common positioning members. As described above, since the piezoelectric member 10, the size of each of which is strictly set, is used for position adjustment in the assembling method of this embodiment, it is possible to provide an extremely high accuracy in the relative positional relation between each nozzle position of one ink jet head 1 and that of the other ink jet head 1.

Parts (the rear end face 10*c* and the side end face 10*d*) of the piezoelectric member are exposed on each of the first and second base plates 30*a*, 30*b* so that the parts can be brought into contact with the pins 101 and cam member 102 which are the common positioning members. Accordingly, the assembling method of this embodiment enables the highly accurate position adjustment.

Furthermore, as in the case of the third embodiment, when the ink jet head unit IJHU of the embodiment is mounted in the image recording apparatus, the cam member 102 can be used as the X and Y-direction positioning member.

[Sixth Embodiment]

Next, an ink jet head unit IJHU according to a sixth embodiment will be described with reference to FIG. 24.

(Constitution)

Figure 24:
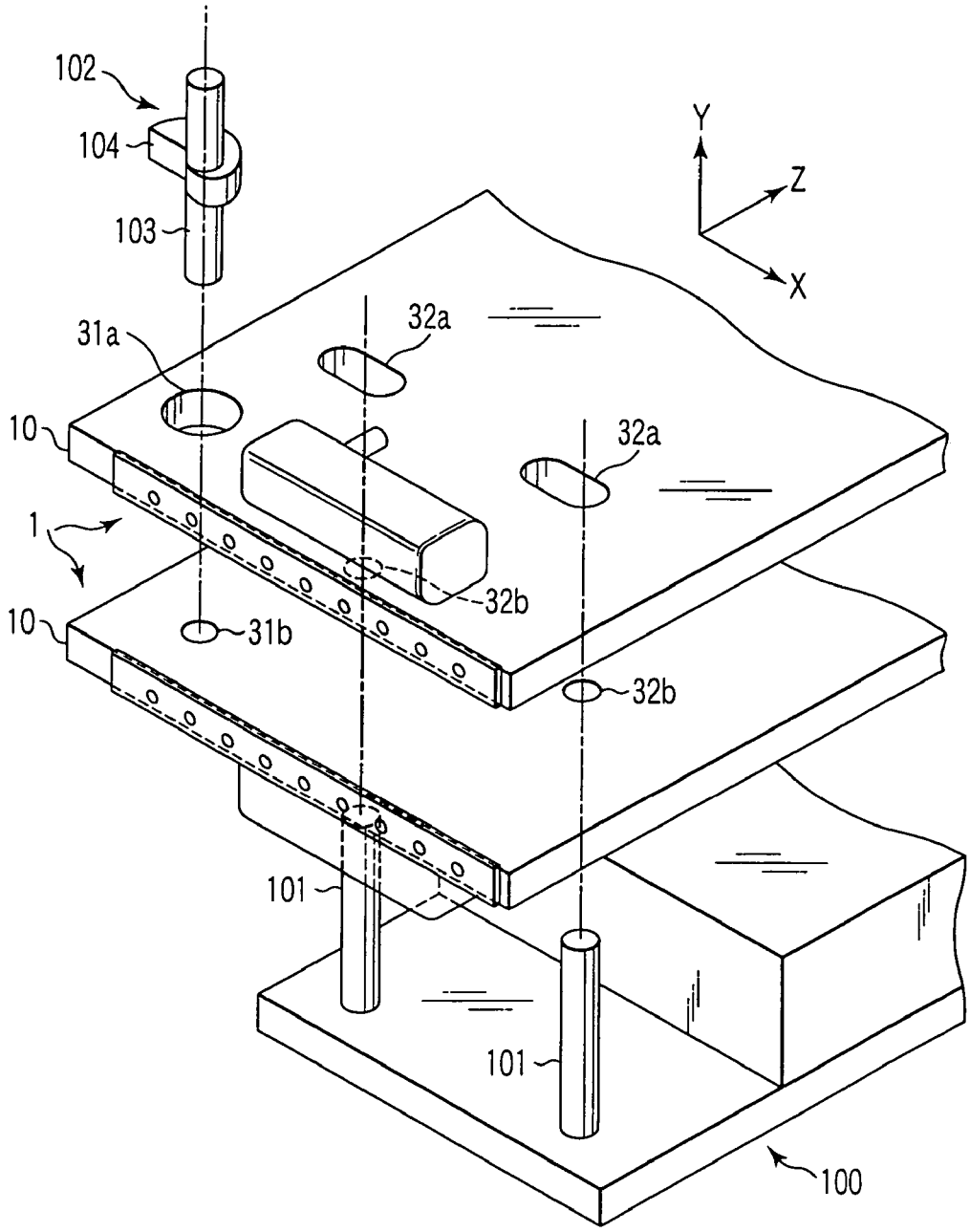
FIG. 24 is an exploded perspective view of an ink jet head unit according to a sixth embodiment.
Figure 25:
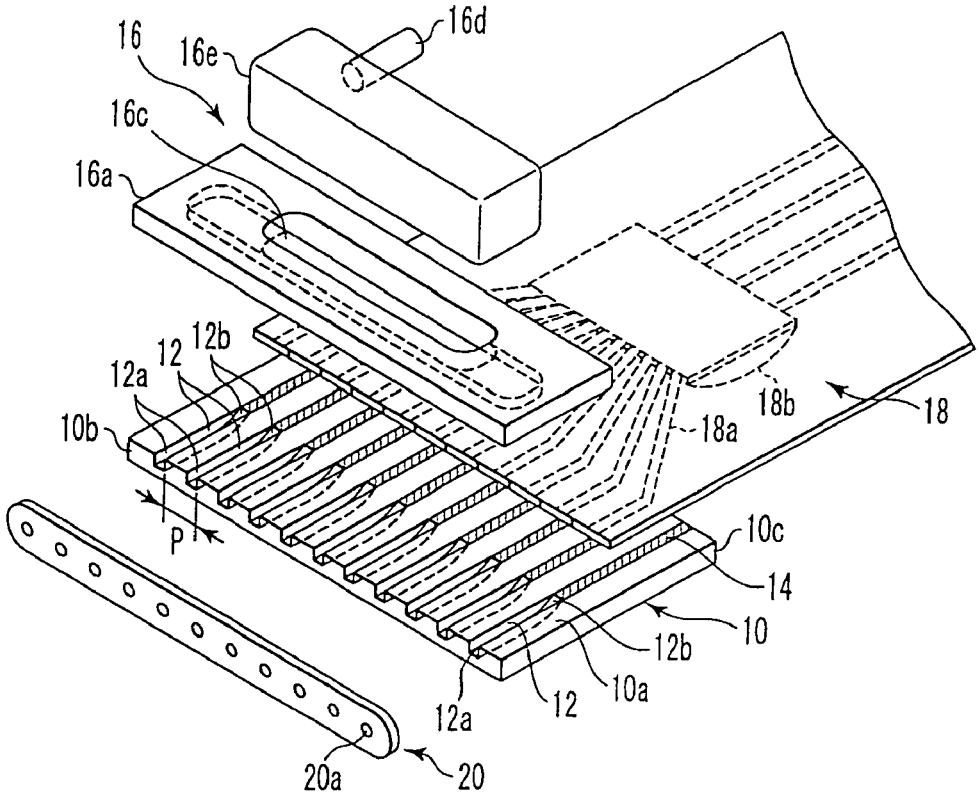
F I G. 25 PRIOR ART
FIG. 25 is a schematic exploded perspective view of a conventional ink jet head.
Figure 26:
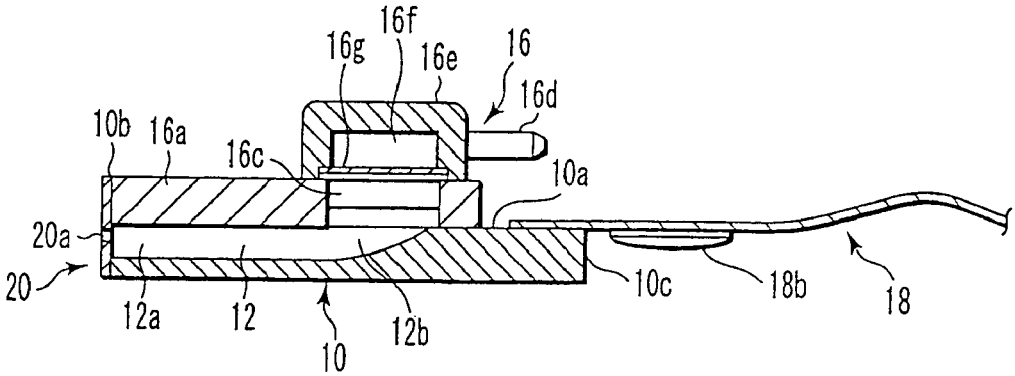
F I G. 26 PRIOR ART
FIG. 26 is a schematic vertical sectional view of the ink jet head of FIG. 25.
Figure 27:
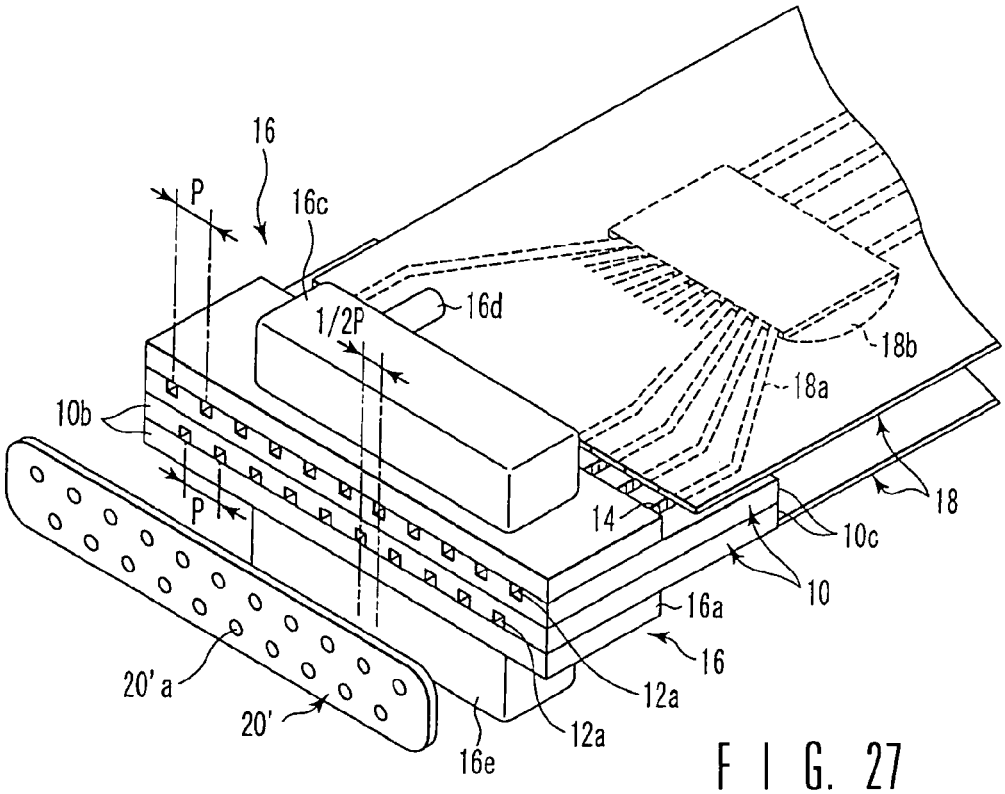
FIG. 27 PRIOR ART
FIG. 27 is a perspective view showing the conventional ink jet heads stacked together to form an ink jet head unit.
Figure 28:
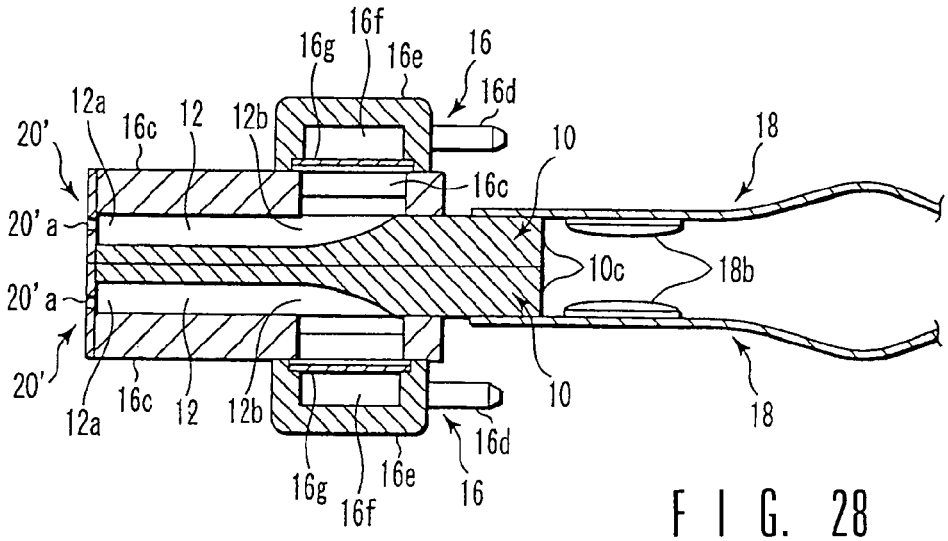
FIG. 28 PRIOR ART
FIG. 28 is a schematic vertical sectional view of the ink jet head unit of FIG. 27.

FIG. 24 is an exploded perspective view of the ink jet head unit IJHU of the embodiment. In FIG. 24, the grooves 12 and the flexible substrates 18 are omitted to simplify an explanation about this embodiment.

The ink jet head unit IJHU of the embodiment is different from that of the first embodiment in the following constitution. The ink jet head unit IJHU of this embodiment does not have the first and second base plates 30*a*, 30*b*. In the ink jet head unit IJHU of this embodiment, the ink ejecting portions of ink jet heads 1 are directly bonded to each other.

In the ink jet head unit IJHU of the embodiment, an upper ink jet head in FIG. 24 is defined as a first ink jet head 1, and a lower ink jet head in FIG. 24 is defined as a second ink jet head 1. As in the case of the first embodiment, each of the first and second ink jet heads 1 has the ink ejecting portion including the piezoelectric member 10.

In the two ink ejecting portions of this embodiment, the holes 31*a*, 31*b*, 32*a*, and 32*b* similar to those of the first embodiment are formed. Specifically, the first piezoelectric member 10 (upper one in FIG. 24) has the round hole 31*a* and the two oblong holes 32*a*. The second piezoelectric member 10 (lower one in FIG. 24) has the round hole 31*b* and the two round holes 32*b*.

(Positioning and Sticking of the Ink Jet Heads)

In this embodiment, the two ink jet heads 1 are fixed as in the case of the first embodiment. And, in this fixing, at first, the positioning in the orthogonal direction is performed as described in the followings.

(Positioning in the Nozzle Arraying Direction)

At first, the piezoelectric members 10 of the ink ejecting portions are placed on the adjustment base 100 in a state in which the bottom or second side surfaces thereof are firmly stuck to each other. At this time, as in the case of the first embodiment, the two positioning pins 101 on the adjustment base 100 penetrate the round holes 32*b* and then are inserted into the oblong holes 32*a*. Additionally, each of the diameter of the round hole 32*b* and the size of the oblong hole 31*a* in its short direction is set substantially equal to the outer diameter of each positioning pin 101. Thus, when the positioning pins 101 are inserted into the round holes 32*b* and the oblong holes 32*a*, the positioning of each of the two piezoelectric members in the Z direction is finished.

(Positioning in the Nozzle Arraying Direction)

After the positioning in the orthogonal direction is finished as described above, the positioning in the nozzle arraying direction is performed. In this positioning, as in the case of the first embodiment, the first ink jet head 1 is moved in the X direction with respect to the second ink jet head 1. In this embodiment, the first piezoelectric member 10 is moved in the nozzle arraying direction (X direction) by the rotation of the cam member 102. With this movement, the position of the first ink jet heads 1 with respect to the second ink jet head in the nozzle arraying direction (X direction) is adjusted. In this embodiment, as in the case of the first embodiment, each nozzle position of the first ink jet head 1 is shifted from that of the second ink jet head 1 by ½ of the one pitch P.

After each nozzle position of the first ink jet head 1 is shifted from that of the second ink jet head 1 by ½ of the one pitch P by the movement of the first ink jet head 1 as described above, the first and second piezoelectric members 10 are fixed to each other by an adhesive.

Further, the cam member 102 is fixed to the piezoelectric members 10 by an adhesive after the positioning of each of the two ink jet heads 1 in the X direction is finished. Additionally, the two flexible substrates 18 extended from the ink jet heads 1 are also adhered to the piezoelectric members 10 by an adhesive.

As described above, in this ink jet head unit assembling method of the embodiment, the two existing ink jet heads are stuck and fixed to each other after they are positioned by the common positioning unit. Therefore, with the ink jet head unit assembling method of this embodiment, it is possible to highly accurately form the ink jet head unit IJHU for a high-density recording.

Besides, in the assembling method of the embodiment, the positions of each of the two ink ejecting heads in the Z and X-directions are adjusted by abutting each piezoelectric member 10, the size of which is strictly set, on the two positioning pins 101 and cam member 102 which are the common positioning members. Since the piezoelectric members 10, the size of which is strictly set, are used for the position adjustments in the assembling method of this embodiment, the relative positional relation between each nozzle position of one ink jet head 1 and that of the other ink jet head 1 can be set very highly accurately.

Incidentally, when the ink jet head unit IJHU of this embodiment is mounted in the image recording apparatus, the cam member 102 can be used as the X and Y-direction positioning member as in the case of the third embodiment.

[Seventh Embodiment]

Next, an ink jet head unit IJHU according to a seventh embodiment will be described with reference to FIG. 6 and FIGS. 7A to 7E.

FIG. 6 is a view showing an air flow through the flow path formed in the base plates. FIGS. 7A to 7E show operations of a suction pen relative to the ink jet head unit IJHU.

The ink jet head unit IJHU of this embodiment has a constitution similar to that of the first embodiment. However, a heat dispersion promoting mechanism described in the followings is adapted for the ink jet head unit of this embodiment.

(Heat Dispersion Promoting Mechanism)

The ink jet head unit IJHU generates heat for various reasons. For example, the ink jet head 1 generates the great amount of heat from the piezoelectric member 10 when it is operated to eject ink.

The IC 18*b* that generates a driving signal applied to the ink jet head 1 is preferably positioned near to the piezoelectric member 10 to decrease deterioration of the driving signal. However, if the heat of the ink jet head 1 is conducted to the IC 18*b*, the IC 18*b* is likely to be affected by the heat and may not accurately generate the driving signal. Further, if the IC 18*b* is heated to a very high temperature, the IC 18*b* is likely to be failed.

Additionally, the heat generated by the piezoelectric member 10 causes an expansion thereof and/or an expansion of each of the first and second base plates 30*a*, 30*b* each of which is adjacent to the piezoelectric member 10. Consequently, even in the ink jet head unit IJHU highly and accurately assembled, the nozzle positional relation between the ink jet heads 1 is failed by the thermal expansions described above.

In order to avoid these above described failures, the heat generated by the piezoelectric member 10 must be efficiently dispersed. In this embodiment, for an efficient heat dispersion, the groove 34 is formed in the bottom or second side surface of each of the first and second base plates 30*a*, 30*b* to constitute the air flow path.

Now, return to FIG. 2 again. FIG. 2 shows the bottom or second side surface (the surface opposite to the surface on which the ink jet head 1 is mounted) of the second base plate 30*b*. A rectangular groove 35, an air flow inlet 36 communicated with the groove 35, and an air flow outlet 37 are formed in the bottom or second side surface of the second base plate 30*b*.

In the base plate 30*b*, the rectangular groove 35 is formed in one side surface opposite to the other side surface to which the piezoelectric member 10 and the flexible substrate 18 are connected. And, as shown in FIG. 6, parts of the rectangular groove 35 are correspond to the parts of the other side surface, at which the piezoelectric member 10 (indicated by a broken line) and the IC 18*b* (indicated by a broken line) are brought into contact with the base plate 30*b*, in the X and Z directions.

Incidentally, in the bottom or second side surface of the first base plate 30*a*, the groove 34 having the same shape and size as those in the second base plate 30*b* is formed (not shown). The air flow path 39 is formed by sticking the bottom or second side surfaces of the first and second base plates 30*a*, 30*b* together.

While the ink jet heads 1 are driven to eject ink from the nozzles, the piezoelectric members 10 generate heat and the heat is conducted to the first and second base plates 30*a*, 30*b*. Since the first and second base plates 30*a*, 30*b* are made of the aluminum material having a highly heat conductive, the heat is relatively highly radiated. However, to promote heat dispersion from the first and second base plates 30*a*, 30*b*, a suction pen 200 is used to assist an air flow in the air flow path 39 in the ink jet head unit IJHU of this embodiment, as shown in FIG. 6. More specifically, the suction pen 200 is fitted to the air flow outlet 37 of the flow path 39. The suction pen 200 sucks warmed air from the flow path 39, and introduces fresh air into the air flow path 39 through the air flow inlet 36. As a result, a rise in temperature in each of the first and second base plates 30*a*, 30*b* can be suppressed.

The suction pen 200 may be exclusively prepared. Alternatively, the suction pen 200 may be prepared by a local suction pen disposed in the image recording apparatus to prevent the ink from clogging in the ink nozzles 20*a*. In order to prevent the ink from clogging in the ink nozzles 20*a*, the local suction pen successively sucks ink in a few of the ink nozzles 20*a* while it is moved on the front end face of the nozzle plate 20 in the nozzle arraying direction.

Hereinafter, an operation of the suction pen 200 prepared by the local suction pen while it performs a nozzle maintenance and a heat dispersion promotion will be described with reference to FIGS. 7A to 7E. FIG. 7A shows the ink jet head unit IJHU which is located in its recording position. At this time, the local suction pen 200 is located in its standby position. When the control portion (not shown) sends a nozzle maintenance command, the ink jet head unit IJHU is retracted (raised) from the recording position to its maintenance position (see FIG. 7B). After the ink jet head unit IJHU is reached at the maintenance position, the local suction pen 200 moves along the nozzle arraying direction, and successively sucks ink form the nozzles 20*a*. More specifically, the local suction pen 200 is reciprocated in a nozzle arraying range of the front end face of the nozzle plate 20 while it is in contact with the nozzle plate 20. During this reciprocation, the local suction pen 200 sucks ink from all of the nozzles 20*a* and prevents an ink clogging or the like (see FIG. 7C).

When the control portion sends a heat dispersion promoting command after the above described maintenance operation of the local suction pen 200 is finished, the local suction pen 200 is returned to its standby position. Subsequently, the ink jet head unit IJHU is lowered to a heat dispersion promoting position (see FIG. 7D). After the ink jet head unit IJHU is reached at the heat dispersion promoting position, the local suction pen 200 is advanced to the air flow outlet 37 of the air flow path 39 in the first and second base plates 30*a*, 30*b*. Then, the local suction pen 200 is pressed onto the air flow outlet 37 (see FIG. 7E). After the local suction pen 200 is reached at the air flow outlet 37, a suction pump (not shown) for the local suction pen 200 starts its operation. By the operation of the suction pump, the local suction pen 200 sucks warmed air in the air flow path 39 in the first and second base plates 30*a*, 30*b* and, introduces fresh air of a relatively low temperature into the air flow path 39 through the air flow inlet 36.

By circulating the air through the air flow path 39 in the first and second base plates 30*a*, 30*b* as described above, the rise in temperature in each of the first and second base plates 30*a*, 30*b* is suppressed. Thus, it is possible to suppress the lowering in the relative position accuracy between the two ink jet heads caused by the thermal expansions of the piezoelectric members 10 and those of the first and second base plates 30*a*, 30*b*, and also to lower an influence of heat on the IC 18*b*.

The heat dispersion promoting mechanism uses the suction pen 200 for a head maintenance and the pump as a driving source for the suction pen 200, both of which are used in the conventional ink jet printer.

Accordingly, this heat dispersion promoting mechanism can suppress a rise in a manufacturing cost and in a size of the ink jet printer.

With the heat dispersion promoting mechanism of this embodiment, the heat generated in the ink jet head unit IJHU while it is driven can be efficiently dispersed to the outside. Thus, it is possible to reduce the influence caused by the thermal expansions of the piezoelectric members and base plates, and also to prevent the deterioration in the performance of the IC and the failure thereof.

[First Modification of the Seventh Embodiment]

Figure 8:
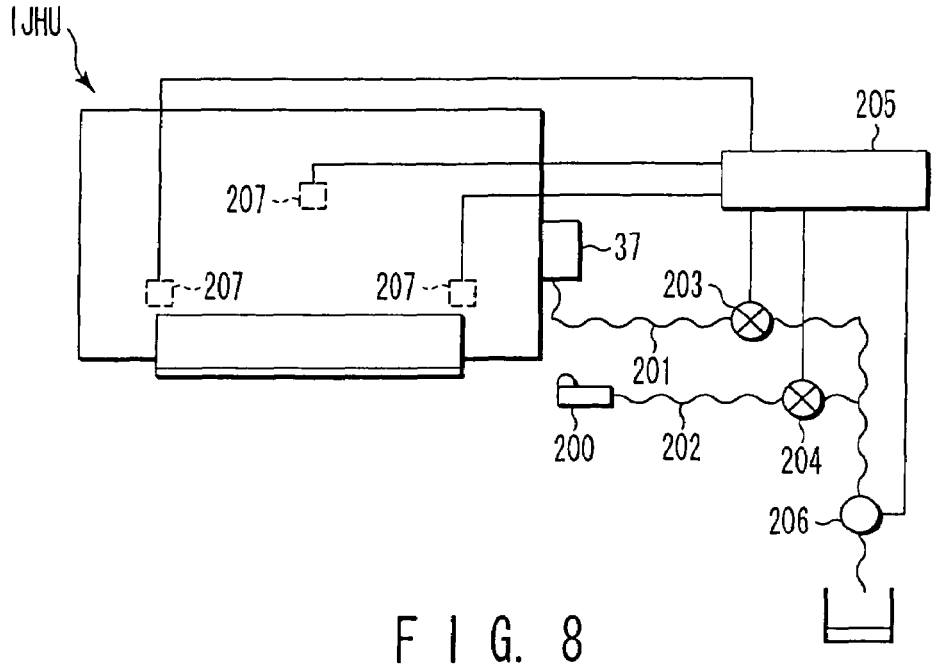
FIG. 8 is a view showing a first modification of the seventh embodiment.

FIG. 8 shows a constitution of the first modification of the Seventh Embodiment.

In this first modification, one end of a heat dispersion tube 201 is connected to the air flow outlet 37 of the ink jet head unit IJHU. The other end of the heat dispersion tube 201 is connected to a tube 202 of the local suction pen 200. Solenoid valves 203, 204 are disposed on the heat dispersion tube 201 and the tube 202 of the local suction pen. Opening and closing of the solenoid valves 203, 204 are controlled by a control portion 205.

In this modification, when the nozzle maintenance is carried out, the control portion 205 drives a pump 206 in a state in which the solenoid valve 204 on the tube 202 of the local suction pen 200 is opened and the solenoid valve 203 on the heat dispersion tube 201 is closed.

When the temperatures of the first and second base plates 30*a*, 30*b* are lowered, the control portion 205 drives the pump 206 in a state in which the solenoid valve 203 on the heat dispersion tube 201 is opened and the solenoid valve 204 on the tube 202 of the local suction pen 200 is closed.

A plurality of temperature sensors 207 are arranged in the groove 34. The control portion 205 determines whether or not to perform the heat dispersion promoting operation, on a basis of output values from the temperature sensors 207. More specifically, the control portion 205 determines whether or not to open the solenoid valve 203 and to close the solenoid valve 204, on the basis of the output values.

Also, in this modification, the local suction pen 200 can use the pump 206 as the suction driving source like in the case of the aforementioned embodiment.

[Second Modification of the Seventh Embodiment]

Figure 9:
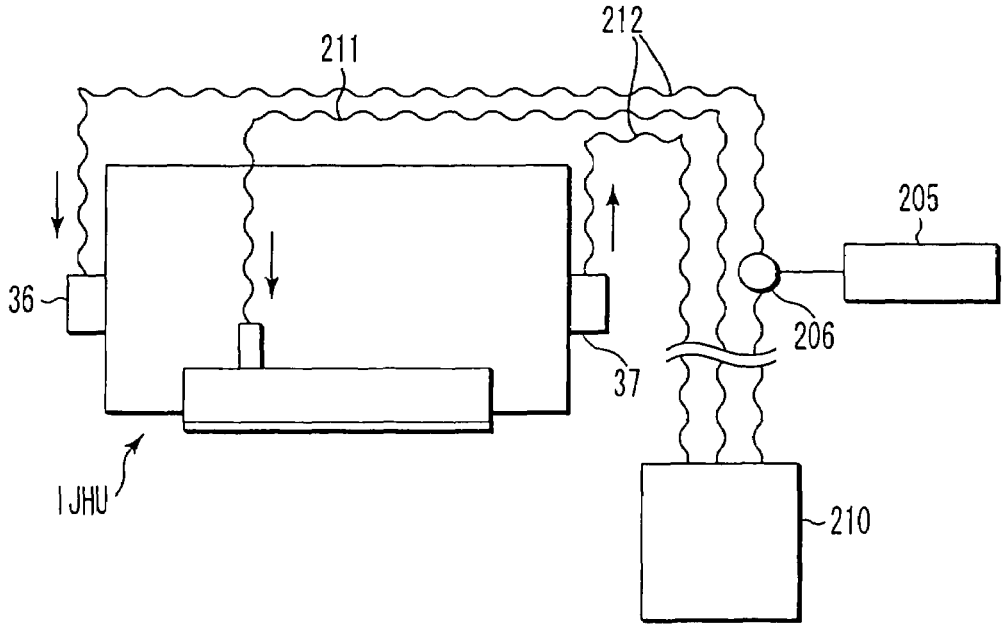
FIG. 9 is a view showing a second modification of the seventh embodiment, in which a structure for heat radiation is added.

Not only a gas such as air but also a liquid such as water or ink may flow through the flow path 39 formed in the first and second base plates 30*a*, 30*b*. FIG. 9 shows another modification of the seventh embodiment, in which ink used for recording is flowed in the flow path 39 in the first and second base plates 30*a*, 30*b* to promote heat dispersion.

A recording ink tube 211 and two heat dispersion tubes 212 (ink supply tube and ink discharge tube) are connected to an ink tank 210 which stores ink used for recording. The recording ink tube 211 is used for supplying ink to the piezoelectric member 10 of the ink jet head 1. The heat dispersion tubes 212 are the ink supply tube for supplying ink and circulating it in the first and second base plates 30*a*, 30*b*, and the ink discharge tube for discharging the ink from the first and second base plates 30*a*, 30*b*.

A suction pump 206 is disposed on each of the recording ink tube 211 and one of the heat dispersion tubes 212, and its operation is controlled by the control portion 205.

In this modification, the recording ink is used as a medium for cooling the first and second base plates 30*a*, 30*b*. Since a deterioration with age of the ink is smaller than that of water, the cooling medium can be used for a long time without a replacement thereof. Additionally, since the ink jet printer has a recording ink tank, there is no need to install an additional tank for the cooling medium in the ink jet printer. This suppresses a rise of the manufacturing cost of the ink jet printer. Further, if a temperature of the recording ink is low, the ink jet printer may not obtain proper ink ejection characteristics. However, in this modification, since the recording ink is circulated in the first and second base plates 30*a*, 30*b* and the temperature of the circulated ink rises, a temperature of the ink jet head can be risen. Thus, the ink jet head can always have proper ink ejection characteristics. Therefore, it is more preferable that the recording ink is used in place of water or the like as the cooling medium.

Further, waste ink obtained in the head maintenance may be supplied to the flow path in the base plates. In order to obtain good ink ejection characteristics even at the initial operation time of the printer, a heater and a temperature sensor are preferably disposed in the groove 34 of the base plate.

The heater is driven when an output value from the temperature sensor 207 is low. For example, when a temperature of the recording ink flowing through the flow path 39 in the base plates is low, the heater is driven to increase the temperature of the circulated recording ink. Thus, a temperature of ink in the ink tank can also be risen. As a result, even in a state in which a temperature of the ink jet head unit is low at a recording start stage, the ink jet head unit IJHU can eject ink with proper ink ejection characteristics since the ink temperature is high.

In each of the above described various embodiments, the X-direction positions of the ink jet heads are adjusted such that the nozzle pitches of the two ink jet heads can be shifted from each other by ½ of the one pitch. However, the X-direction positions of the ink jet heads may be adjusted so that ink dot pitch of the ink dots provided on the recording medium by one ink jet head is shifted from that by the other ink jet head by ½ of one ink dot pitch.

What is claimed is:

1. A method of assembling an ink jet head unit, which includes a plurality of ink jet heads fixed together such that a first ink jet head is fixed to a second ink jet head adjacent thereto, each said ink jet head including an ink ejecting portion in which a plurality of nozzles to eject ink are arrayed and a holding member to hold the ink ejecting portion, said method comprising:

positioning each of the ink jet heads by abutting a part of the holding member thereof on a common positioning unit; and fixing the plurality of ink jet heads such that the first ink jet head is fixed to the second ink jet head adjacent thereto, after the ink jet heads are positioned.

2. The method according to claim 1, wherein the common positioning unit comprises an eccentric cam member which is operatively coupled to the holding member of the first ink jet head, and wherein the positioning of the ink jet heads includes adjusting a position of the first ink jet head with respect to the second ink jet head in a nozzle arraying direction along which the nozzles are arrayed, by rotating the eccentric cam member.

3. The method according to claim 2, wherein, in the position adjusting of the first ink jet head with the eccentric cam member, the position of the first ink jet head with respect to the second ink jet head is adjusted to shift a position of each nozzle of the ink ejecting portion of the first ink jet head from a position of each nozzle of the ink ejecting portion of the second ink jet head by a predetermined distance.

4. The method according to claim 3, wherein the predetermined distance is ½ of one pitch in the nozzle array in the ink ejecting portion of each ink jet head.

5. The method according to claim 1, wherein the common positioning unit comprises an abutting member including at least one common positioning pin which abuts against the holding members of the plurality of ink jet heads, and wherein the positioning of the ink jet heads includes adjusting positions of the ink jet heads in a direction that is orthogonal to a nozzle arraying direction along which the nozzles are arrayed and that extends along an ink ejecting direction in which ink is ejected from the nozzles, by abutting the ink jet heads on the at least one positioning pin of the abutting member.

6. The method according to claim 1, wherein, in the fixing of the plurality of ink jet heads, the holding members of the ink jet heads are adhered to each other with an adhesive.

7. The method according to claim 6, wherein, in the fixing of the plurality of ink jet heads, the common positioning unit is fixed to the ink jet heads.

8. The method according to claim 6, wherein, in the fixing of the plurality of ink jet heads, an adhesive application range in which the adhesive is applied between the holding members of the ink jet heads is narrower than a width of each ink ejecting portion in a nozzle arraying direction along which the nozzles are arrayed.

9. The method according to claim 1, wherein, in the fixing of the plurality of ink jet heads, the holding members of the ink jet heads are fixed to each other by screws.

10. A method of assembling an ink jet head unit including a plurality of ink ejecting portions, each of which includes a plurality of arrayed nozzles to eject ink and a holding member that holds the ink ejecting portions on opposite surfaces thereof, said method comprising:

positioning the ink ejecting portions by abutting a part of each ink ejecting portion on a common positioning unit; and fixing the plurality of ink ejecting portions on the opposite surfaces of the holding member after the ink ejecting portions are positioned.

11. The method according to claim 10, wherein the common positioning unit comprises an eccentric cain member which is operatively coupled to a first one of the ink ejecting portions held on the holding member; and wherein the positioning of the ink ejecting portions includes adjusting a position of the first ink ejecting portion with respect to a second one of the ink ejecting portions held on the holding member in a nozzle arraying direction along which the nozzles are arrayed, by rotating the eccentric cam member.

12. The method according to claim 11, wherein, in the position adjusting of the first ink ejecting portion with the eccentric cam member, the position of the first ink ejecting portion with respect to the second ink ejecting portion is adjusted to shift a position of each nozzle of the first ink ejecting portion from a position of each nozzle of the second ink ejecting portion by a predetermined distance.

13. The method according to claim 10, wherein the common positioning unit comprises an abutting member including at least one common positioning pin which abuts against the plurality of ink ejecting portions held on the opposite surfaces of the holding member; and wherein the positioning of the ink ejecting portions includes adjusting positions of the ink ejecting portions in a direction that is orthogonal to a nozzle arraying direction along which the nozzles are arrayed and that extends along an ink ejecting direction in which ink is ejected from the nozzles, by abutting the ink ejecting portions on the at least one positioning pin of the abutting member.

14. The method according to claim 10, wherein, in the fixing of the plurality of ink ejecting portions, the ink ejecting portions are fixed on the opposite surfaces of the holding member with an adhesive.

* * * * *